US010077512B2

(12) United States Patent
Kuo et al.

(10) Patent No.: US 10,077,512 B2
(45) Date of Patent: Sep. 18, 2018

(54) METHOD FOR KNITTING INTEGRAL SHOE UPPER FABRIC BY CIRCULAR KNITTING MACHINE AND INTEGRAL SHOE UPPER FABRIC THEREOF

(71) Applicant: Aknit International Ltd., Apia (WS)

(72) Inventors: Ming-Sheng Kuo, Apia (WS); Yu-Lin Li, Apia (WS); Chien-Hui Yang, Apia (WS)

(73) Assignee: Aknit International Ltd., Apia (WS)

( * ) Notice: Subject to any disclaimer, the term of this patent is extended or adjusted under 35 U.S.C. 154(b) by 156 days.

(21) Appl. No.: 15/237,018

(22) Filed: Aug. 15, 2016

(65) Prior Publication Data

US 2018/0042340 A1 Feb. 15, 2018

(51) Int. Cl.

| | |
|---|---|
| ***D04B 1/10*** | (2006.01) |
| ***A43B 1/04*** | (2006.01) |
| ***A43B 23/04*** | (2006.01) |
| ***D04B 1/00*** | (2006.01) |

(52) U.S. Cl.

CPC ..... *D04B 1/108* (2013.01); *A43B 1/04* (2013.01); *A43B 23/042* (2013.01); *D04B 1/00* (2013.01)

(58) Field of Classification Search

CPC . D04B 1/108; D04B 9/42; D04B 9/46; D04B 9/56; A43B 23/0245; A43B 1/04; A43B 23/042

See application file for complete search history.

(56) References Cited

U.S. PATENT DOCUMENTS

| | | | | |
|---|---|---|---|---|
| 2,147,197 | A * | 2/1939 | Glidden | A43B 1/02 36/3 A |
| 2,400,692 | A * | 5/1946 | Herbert | A43B 1/04 36/10 |
| 2,675,631 | A * | 4/1954 | Doughty | A43B 1/04 36/12 |
| 6,931,762 | B1 * | 8/2005 | Dua | A43B 1/04 12/142 G |
| 6,986,269 | B2 * | 1/2006 | Dua | A43B 1/04 66/177 |
| 7,131,296 | B2 * | 11/2006 | Dua | A43B 1/04 66/178 R |
| 8,595,878 | B2 * | 12/2013 | Huffa | A43B 9/00 12/145 |
| 2010/0281631 | A1 * | 11/2010 | Dua | A43B 1/04 12/146 C |

FOREIGN PATENT DOCUMENTS

| | | |
|---|---|---|
| TW | M400227 | 3/2011 |
| TW | 201603735 A | 2/2016 |
| TW | 201609010 A | 3/2016 |
| TW | 201514353 A | 4/2016 |

* cited by examiner

*Primary Examiner* — Danny Worrell

(74) *Attorney, Agent, or Firm* — Muncy, Geissler, Olds & Lowe, P.C.

(57) ABSTRACT

An integral shoe upper fabric, knitted by a round knitting machine from at least one non-elastic yarn, includes: a first reserved suture section including a first opening; a first toe knitted section; a first foot body knitted section; a first sole extension section; a first heel knitted section; a second sole extension section; a second foot body knitted section; a second toe knitted section; and a second reserved suture section including a second opening.

18 Claims, 26 Drawing Sheets

METHOD FOR KNITTING INTEGRAL SHOE UPPER FABRIC BY CIRCULAR KNITTING MACHINE AND INTEGRAL SHOE UPPER FABRIC THEREOF

FIELD OF THE INVENTION

The present invention relates to a shoe upper fabric, and particularly to an integral shoe upper fabric knitted by a circular knitting machine.

BACKGROUND OF THE INVENTION

Based on different shoe upper materials, shoes have different fabrication methods and shoe upper structures. The shoe upper and fabrication method discussed herein are mainly associated with a shoe upper material made of a fabric for shoes. For example, a known technology is as disclosed by the Taiwan Patent Publication No. 201609010. This disclosure provides a shoe object including a shoe upper and a sole structure secured to the shoe upper. The shoe object of the above current technology is knitted by a flat bed knitting machine. In addition to a slow knitting speed of a flat bed, the knitting shoe object further needs manual splicing and sewing to form the shoe upper, resulting in an issue that factories are incapable of reducing production costs.

In another known technology as the Taiwan Patent Publication No. 201603735 disclosing a shoe object, the shoe object includes a seamless sleeve portion or fabric shoe upper formed by a knitting assembly removed from one single warp knit fabric element. From the content of the above known technology, the seamless sleeve portion or fabric shoe upper of the above known technology is knitted by a circular knitting machine. The circular knitting machine solves the issue of a slow speed of a flat knitting machine. However, to knit the shoe object using the above known technology, in addition to the issue of the procedure of manual splicing and sewing, excessive parts of the shoe object need to be first trimmed before the splicing procedure. Thus, due to the waste material produced by the excessive parts trimmed off, not only production costs are increased by also a waste in raw materials is further caused.

In another known technology as the Taiwan Patent No. M400227 disclosing a sock shoe, the sock shoe includes a sock body. The sock body includes a foot covering portion including an end opening, and a sleeve portion extending outwards from the end opening of the foot covering portion. The sock shoe further includes an insulation layer, which is made of an elastic material and is a formed integral to appear shoe-shaped at a surface of the foot covering portion. In this known technology, the sock body is first knitted, and is then processed to fabricate the shoe. However, the sock body itself is not exactly suitable for directly fabricating into a shoe upper, with main reasons being as follows. First of all, an elastic yarn (a fiber material with flexibility), as the main knitting material when the sock body is knitted, is extremely prone to deformation due to an external force when employed as the shoe upper. Even with a shaping object (the insulation layer in an elastic material) covering the sock body, the shaping object may be easily broken or damaged as the sock body lacks a supporting effect. Secondly, although the thickness of the sock body may be increased by a double-sided knitting method during the knitting process, the sock body is nonetheless a single-layer fabric. In order to wear the sock body as the shoe upper of a shoe, the sock body needs to have support and wear resistance greater than those of a common fabric. However, the sock body has not only insufficient support but is also a single-layer fabric with lower wear resistance, and is thus an inappropriate material for directly fabricating into a shoe upper. Thirdly, another sock body may accommodate around the original sock body to form a double-layer fabric and to thus further reinforce the wear resistance of the sock body. However, as the two separate sock bodies need to be appropriately sleeved with each other, the alignment process of the corresponding edges and corners inevitably encounter increased complications, and can only be completed with great amounts of experience and manpower, or else product defective rate may be increased to contrarily lead to increased labor and time costs.

SUMMARY OF THE INVENTION

Therefore, it is a primary object of the present invention to solve the issues of the known technologies. That is, it is a primary object of the present invention to provide an integral shoe upper fabric for a shoe upper with sufficient support. Further, the integral shoe upper fabric may be promptly and reversibly folded in half to form a double-layer structure with high wear resistance, thereby effectively reducing labor and material costs as well as significantly enhancing production efficiency.

To achieve the above object, the present invention provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section including a first opening from the yarn; operating the circular knitting machine to knit a first toe knitted section in continuation from an upper edge of the first reserved suture section; operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section; operating the circular knitting machine to knit a first sole extension section in continuation from a lower edge of the first foot body knitted section; operating the circular knitting machine to turn the knitting direction from the first sole extension section, and sequentially knit a first heel knitted section and a second heel knitted section, with a first heel turning interknitting line interknitted between the first sole extension section and the first heel knitted section; operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line; operating the circular knitting machine to combine and knit in continuation from an edge of the second sole extension section and an upper edge of the first foot body knitted section to form a second foot body knitted section; operating the circular knitting machine to knit in continuation from an upper edge of the second foot body knitted section, and turn the knitting direction to knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

To achieve the above object, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section including a first opening from the yarn; operating the circular knitting machine to knit a first toe knitted section in continuation from an upper edge of the first reserved suture section; operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section; operating the circular knitting machine to knit a first instep extension section in continuation from an upper edge of the first foot body knitted section; operating the circular knitting machine to knit a sole extension section in continuation from a lower edge of the first foot body knitted section; operating the circular knitting machine to turn the knitting direction from the first sole extension section, and sequentially knit a first heel knitted section and a second heel knitted section, with a first heel turning interknitting line interknitted between the first sole extension section and the first heel knitted section; operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line; operating the circular knitting machine to turn the knitting direction from the first instep extension section, and knit a second instep extension section in continuation from the first instep extension section, with an instep extension turning interknitting line interknitted between the first instep extension section 33 and the second instep extension section; operating the circular knitting machine to combine and knit in continuation from an edge of the second sole extension section and an edge of the second instep extension section to form a second foot body knitted section; operating the circular knitting machine to knit in continuation from an upper edge of the second foot body knitted section, turn the knitting direction, and knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

To achieve the above object, the present invention further provides a method for knitting an integral shoe upper fabric. The method includes: providing a circular knitting machine, and providing at least one non-elastic yarn for the circular knitting machine to perform knitting; operating the circular knitting machine to knit a first reserved suture section including a first opening from the yarn; operating the circular knitting machine to knit a first toe knitted section in continuation from an upper edge of the first reserved suture section; operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section; operating the circular knitting machine to knit a first sole extension section in continuation from a lower edge of the first foot body knitted section; operating the circular knitting machine to turn the knitting direction from the first sole extension section, and knit a first heel knitted section in continuation from the first sole extension section, with a first heel turning interknitting line interknitted between the first sole extension section and the first heel knitted section; operating the circular knitting machine to knit a first heel extension section in continuation from a lower edge of the first heel knitted section; operating the circular knitting machine to turn the knitting direction, and knit a second heel extension section in continuation from the first heel extension section, with a heel extension turning interknitting line interknitted between the first heel extension section and the second heel extension section; operating the circular knitting machine to combine and knit in continuation from the second heel extension section and a side edge of the first heel knitted section to form a second heel knitted section; operating the circular knitting machine turn the knitting direction from the second heel knitted section, and knit a second sole extension section, with a second heel turning interknitting line interknitted between the second heel knitted section and the second sole extension section and symmetric to the first heel turning interknitting line; operating the circular knitting machine to combine and knit in continuation from an edge of the second sole extension section and an upper edge of the first foot body knitted section to form a second foot body knitted section; operating the circular knitting machine to knit from an upper edge of the second foot body knitted section, turn the knitting direction, and knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

To achieve the above object, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section including a first opening from the yarn; operating the circular knitting machine to knit a first toe knitted section in continuation from an upper edge of the first reserved suture section; operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section; operating the circular knitting machine to knit a first instep extension section in continuation from an upper edge of the first foot body knitted section; operating the circular knitting machine to knit a first sole extension section in continuation from a lower edge of the first foot body knitted section; operating the circular knitting machine to turn the knitting direction, and knit a first heel knitted section in continuation from the first sole extension section, with a first heel turning interknitting line interknitted between the first sole extension section and the first heel knitted section; operating the circular knitting machine to knit a first heel extension section in continuation from a lower edge of the first heel knitted section; operating the circular knitting machine to turn the knitting direction, and knit a second heel extension section in continuation from the first heel extension section, with a heel extension turning interknitting line interknitted between the first heel extension section and the second heel extension section; operating the circular knitting machine to combine and knit in continuation from the second heel extension section and a side edge of the first heel knitted section to form a second heel knitted section; operating the circular knitting machine turn the knitting direction from the second heel knitted section, and knit a second sole extension section, with a second heel turning interknitting line interknitted between the second heel knitted section and the second sole extension section and symmetric to the first heel turning interknitting line; operating the circular knitting machine to turn the knitting direction, and knit a second instep extension section in continuation from the first instep extension section, with an instep extension turning interknitting line interknitted between the first instep extension section and the second instep extension section; operating the circular knitting machine to combine and knit in continuation from an edge of the second sole extension section and an edge of the second instep extension section to form a second foot body knitted section; operating the circular knitting machine knit in continuation from an upper edge of the second foot body knitted section, turn the knitting direction, and knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

To achieve the above object, the present invention further provides an integral shoe upper fabric knitted by a circular knitting machine. The integral shoe upper fabric is knitted from at least one non-elastic yarn provided to the circular knitting machine, and includes: a first reserved suture section knitted by the circular knitting machine and including a first opening; a first toe knitted section located at an upper edge side of the first reserved suture section and knitted by the circular knitting machine; a first foot body knitted section located at a turning side of the first toe knitted section and a lower edge side of the first reserved suture section, and knitted by the circular knitting machine, and a first toe turning interknitting line formed between the first toe knitted section and the first foot body knitted section; a first sole extension section located at a lower edge side of the first foot body knitted section and knitted by the circular knitting machine; a first heel knitted section located at a turning side of the first sole extension section and knitted by the circular knitting machine, and a first heel turning interknitting line formed between the first sole extension section and the first heel knitted section; a second heel knitted section located at an edge side of the first heel knitted section and knitted by the circular knitting machine; a second sole extension section located at a turning side of the second heel knitted section and knitted by the circular knitting machine, and a second heel turning interknitting line that is formed between the second heel knitted section and the second sole extension section and is symmetric to the first heel turning interknitting line; a second foot body knitted section located at an edge side of the second sole extension section and knitted by the circular knitting machine; a second toe knitted section located at an upper turning edge side of the second foot body knitted section and knitted by the circular knitting machine, and a second toe turning interknitting line formed between the second foot body knitted section and the second toe knitted section; and a second reserved suture section located at an edge side of the second toe knitted section and a lower edge side of the second foot body knitted section, knitted by the circular knitting machine, and including a second opening that is asymmetric to the direction of the first opening of the first reserved suture section.

The integral shoe upper fabric knitted by a circular knitting machine further includes a reinforcing additional section, which is located between the first heel knitted section and the second heel knitted section and is knitted by the circular knitting machine.

The integral shoe upper fabric knitted by a circular knitting machine further includes a first instep extension section located at an upper edge side of the first foot body knitted section and knitted by the circular knitting machine, and a second instep extension section located at a turning side of the first instep extension section and knitted by the circular knitting machine, and an instep extension turning interknitting line is formed between the first instep extension section and the second instep extension section.

The integral shoe upper fabric knitted by a circular knitting machine further includes reinforcing additional section, which is located between the first foot body knitted section and the first instep extension section and is knitted by the circular knitting machine.

The integral shoe upper fabric knitted by a circular knitting machine further includes at least one first heel extension section located at a lower edge of the first heel knitted section and knitted by the circular knitting machine, and at least one second heel extension section located at a turning side of the first heel extension section and knitted by the circular knitting machine, and at least one heel extension turning interknitting line is formed between the first heel extension section and the second heel extension section.

The integral shoe upper fabric knitted by a circular knitting machine further includes a reinforcing additional section, which is located between the first heel knitted section and the first heel extension section and is knitted by the circular knitting machine.

Further, in the integral shoe upper fabric knitted by a circular knitting machine, the first opening is sutured to form a suture line appearing as an inverted T, an inverted Y or a horizontal I, and the first reserved suture section is appropriately trimmed after the suture line is formed.

Through the above technical solutions, the present invention achieves following effects compared to known technologies. First of all, as the integral shoe upper fabric of the present invention is knitted from a non-elastic yarn by a circular knitting machine, the integral shoe upper fabric of the present invention not only can be knitted at a fast speed but also provides sufficient intrinsic support required by a shoe upper. Secondly, the integral shoe upper fabric of the present invention can be promptly folded in reverse by half, and readily forms a double-layer structure by aligning the corners and edges, thereby enhancing the wear resistance. Thirdly, because the integral shoe upper fabric of the present invention is a one-time fabric knitted by a circular knitting machine, working hours for splicing and suturing different fabrics are eliminated while minimal waste materials are produced, and therefore labor and material costs can be effectively reduced and production efficiency can be significantly enhanced.

DETAILED DESCRIPTION OF THE PREFERRED EMBODIMENTS

Figure 26:
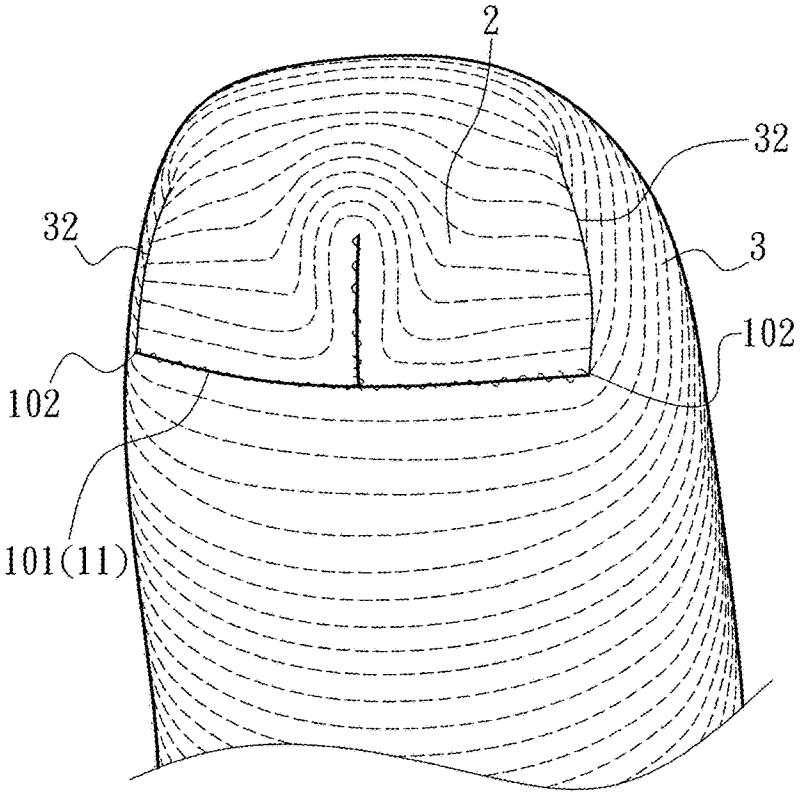
FIG. 26 is a partial perspective view of the first opening sutured as an inverted T in embodiments of the present invention.
Figure 25:
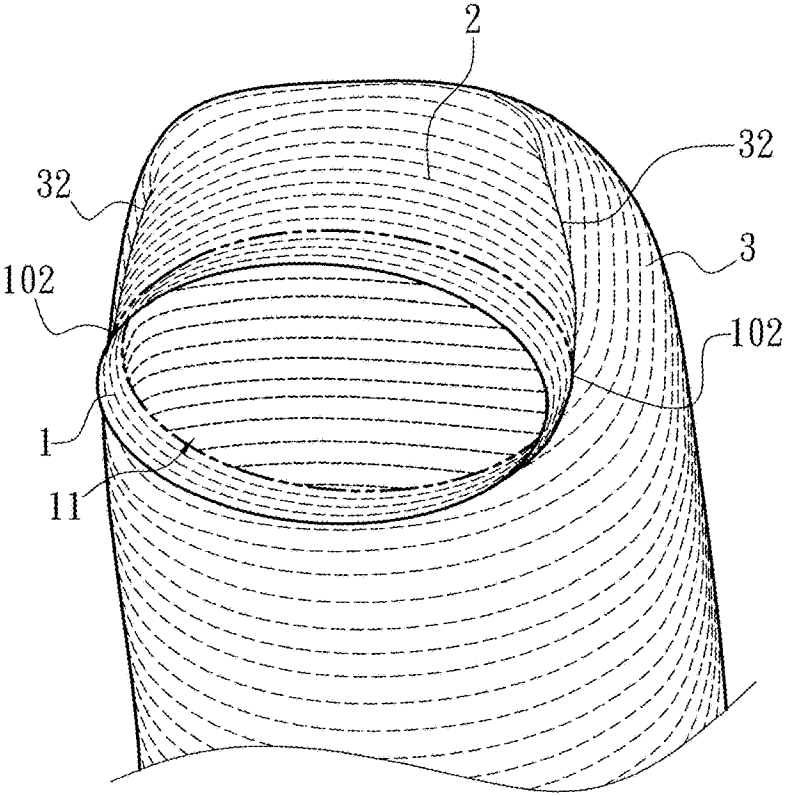
FIG. 25 is a partial perspective view before a first opening is sutured in embodiments of the present invention.
Figure 28:
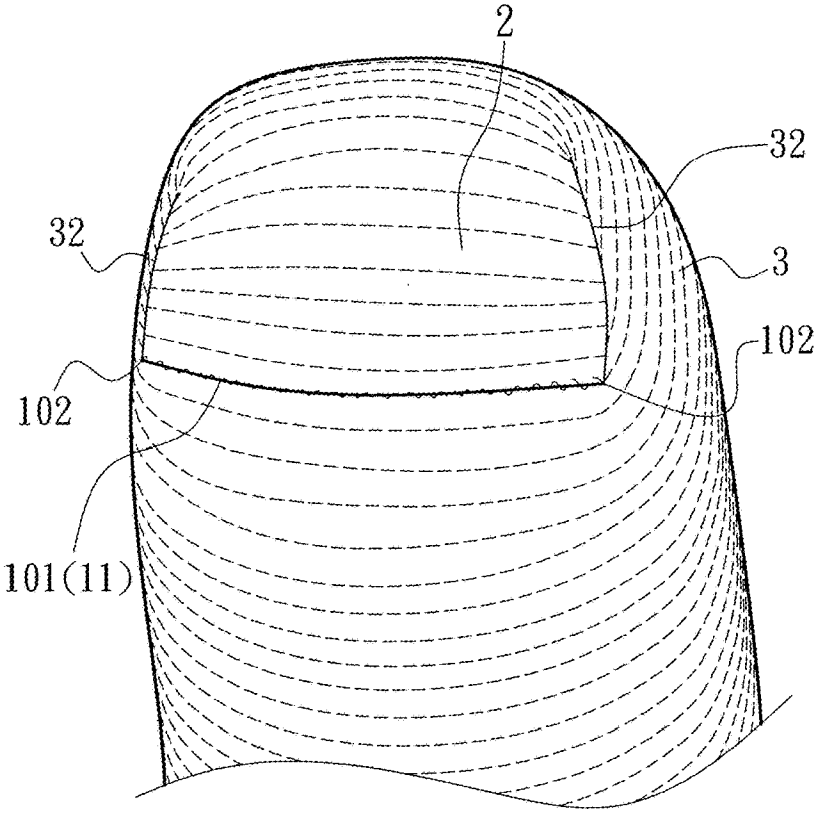
FIG. 28 is a partial perspective view of the first opening sutured as a horizontal I in embodiments of the present invention.
Figure 27:
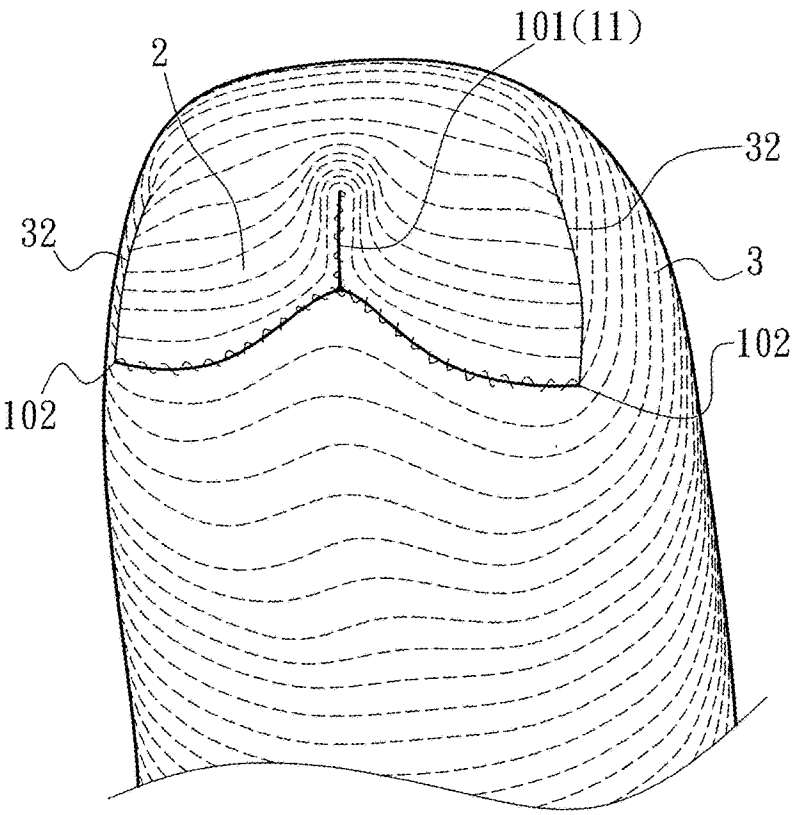
FIG. 27 is a partial perspective view of the first opening sutured as an inverted Y in embodiments of the present invention.

The present invention provides a method for knitting an integral shoe upper fabric by a circular knitting machine and an integral shoe upper fabric thereof. Details of preferred embodiments and technical contents of the present invention are given with the accompanying drawings below. Refer to FIG. 1 to FIG. 6 showing a planar appearance diagram and a section view according to a first preferred embodiment of the present invention, continuous operation diagrams before the first preferred embodiment is processed to a shaped shoe upper, and a section view of the first preferred embodiment having been processed to a shaped shoe upper. It is clearly seen from the diagrams that, the present invention provides an integral shoe upper fabric knitted by a circular knitting machine. The integral shoe upper fabric 100 is knitted from at least one non-elastic yarn provided to the circular knitting machine, and includes: a first reserved suture section 1 knitted by the circular knitting machine and including a first opening 11; a first toe knitted section 2 located at an upper edge side of the first reserved suture section 1 and knitted by the circular knitting machine; a first foot body knitted section 3 located at a turning side of the first toe knitted section 2 and a lower edge side of the first reserved suture section 1, and knitted by the circular knitting machine, and a first toe turning interknitting line 32 formed between the first toe knitted section 2 and the first foot body knitted section 3; a first sole extension section 4 located at a lower edge side of the first foot body knitted section 3 and knitted by the circular knitting machine; a first heel knitted section 5 located at a turning side of the first sole extension section 4 and knitted by the circular knitting machine, and a first heel turning interknitting line 54 formed between the first sole extension section 4 and the first heel knitted section 5; a second heel knitted section 60 located at an edge side of the first heel knitted section 5 and knitted by the circular knitting machine; a second sole extension section 7 located at a turning side of the second heel knitted section 60 and knitted by the circular knitting machine, and a second heel turning interknitting line 76 that is formed between the second heel knitted section 60 and the second sole extension section 7 and is symmetric to the first heel turning interknitting line 54; a second foot body knitted section 80 located at an edge side of the second sole extension section 7 and knitted by the circular knitting machine; a second toe knitted section 90 located at an upper turning edge side of the second foot body knitted section 80 and knitted by the circular knitting machine, and a second toe turning interknitting line 98 formed between the second foot body knitted section 80 and the second toe knitted section 90; and a second reserved suture section 91 located at an edge side of the second toe knitted section 90 and a lower edge side of the second foot body knitted section 80, knitted by the circular knitting machine, and including a second opening 911 that is asymmetric to the direction of the first opening 11 of the first reserved suture section 1. It should be noted that, the first opening 11 before having been sutured is as shown in FIG. 25, and may form a suture line 101 appearing as an inverted T, an inverted Y or a horizontal I after having been sutured, as shown in FIG. 26 to FIG. 28. Further, after the suture line 101 is formed, the first reserved suture section 1 may be appropriately trimmed as shown in FIG. 2 to FIG. 6. Further, the second opening 911 may form another suture line 101 appearing as an inverted T, an inverted Y or a horizontal I after having been sutured, and may be appropriately trimmed as shown in FIG. 2 to FIG. 6 after the suture line 101 is formed. To better explain the present invention, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section 1 including a first opening 11 from the yarn; operating the circular knitting machine to knit a first toe knitted section 2 in continuation from an upper edge of the first reserved suture section 1; operating the circular knitting machine to turn the knitting direction from the first toe knitted section 2, combine a lower edge of the first reserved suture section 1, and knit in continuation to form a first foot body knitted section 3, with a first toe turning interknitting line 32 interknitted between the first toe knitted section 2 and the first foot body knitted section 3; operating the circular knitting machine to knit a first sole extension section 4 in continuation from a lower edge of the first foot body knitted section 3; operating the circular knitting machine to turn the knitting direction from the first sole extension section 4, and sequentially knit a first heel knitted section 5 and a second heel knitted section 60, with a first heel turning interknitting line 54 interknitted between the first sole extension section 4 and the first heel knitted section 5; operating the circular knitting machine to turn the knitting direction from the second heel knitted section 60, and knit a second sole extension section 7, with a second heel turning interknitting line 76 interknitted between the second heel knitted section 60 and the second sole extension section 7 and symmetric to the first heel turning interknitting line 54; operating the circular knitting machine to combine and knit in continuation from an edge of the second sole extension section 7 and an upper edge of the first foot body knitted section 3 to form a second foot body knitted section 80; operating the circular knitting machine to knit in continuation from an upper edge of the second foot body knitted section 80, and turn the knitting direction to knit a second toe knitted section 90, with a second toe turning interknitting line 98 interknitted between the second foot body knitted section 80 and the second toe knitted section 90; and operating the circular knitting machine to combine and knit in continuation from an edge of the second toe knitted section 90 and a lower edge of the second foot body knitted section 80 to form a second reserved suture section 91 including a second opening 911 that is asymmetric to the direction of the first opening 11 of the first reserved suture section 1. Further, subsequent steps of the present invention for processing the integral shoe upper fabric 100 to a shaped shoe upper 103 are as below. In step 1, in the integral shoe upper fabric 100, the second opening 911 is sutured from an intersection point 102 from which the second reserved suture section 91 is connected to one second toe turning interknitting line 98 to another intersection point 102 of another second toe turning interknitting line 98, and the second reserved suture section 91 is appropriately trimmed. In step 2, outside the integral shoe upper fabric 100, the first opening 11 is sutured from an intersection point 102 at which the first reserved suture section 1 is connected to one first toe turning interknitting line 32 to another intersection point 102 of another first toe turning interknitting line 32, and the first reserved suture section 1 is appropriately trimmed.

Figure 1:
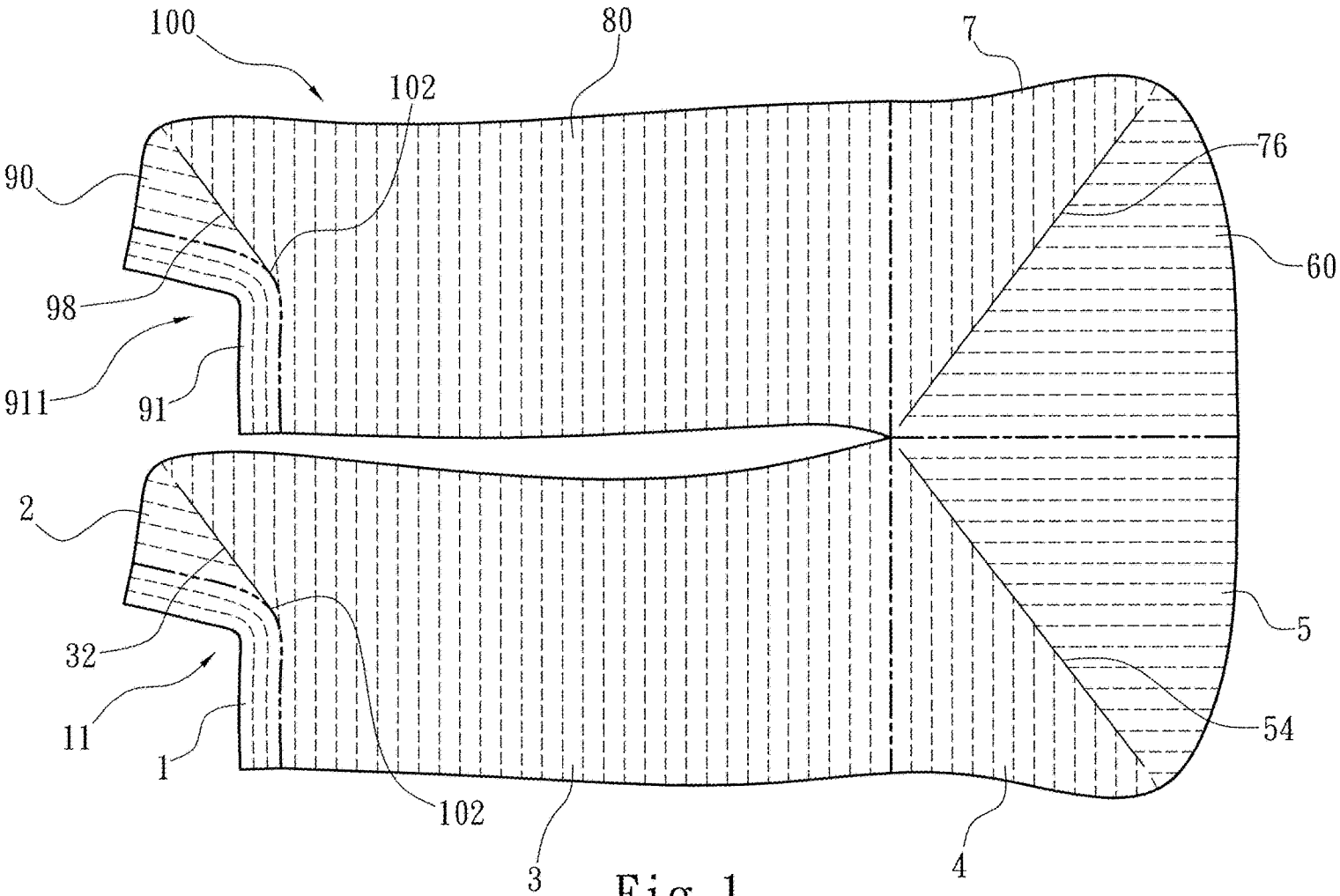
FIG. 1 is a planar appearance schematic diagram according to a first preferred embodiment of the present invention.
Figure 2:
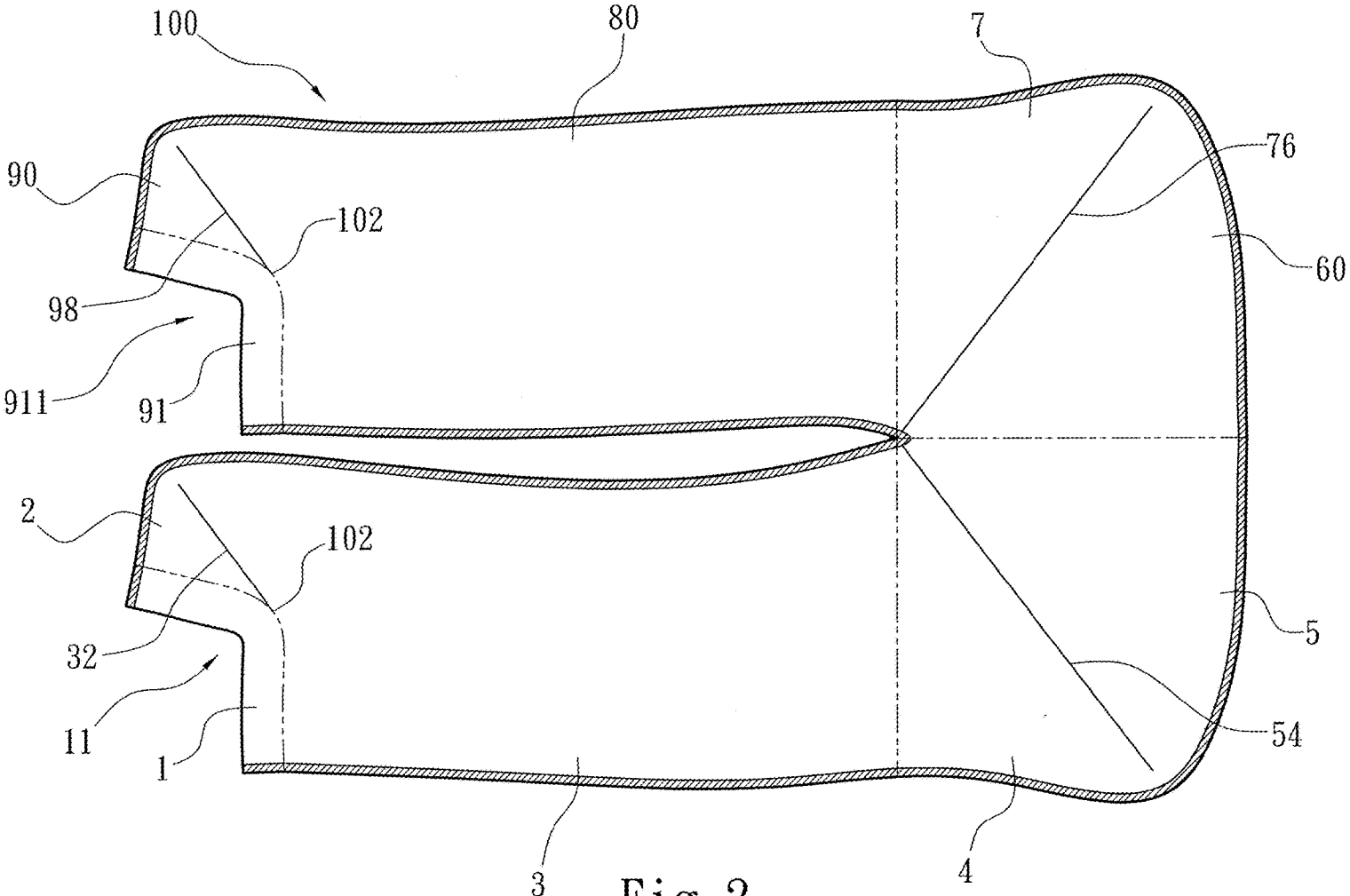
FIG. 2 is a section view of FIG. 1 of the present invention.
Figure 3:
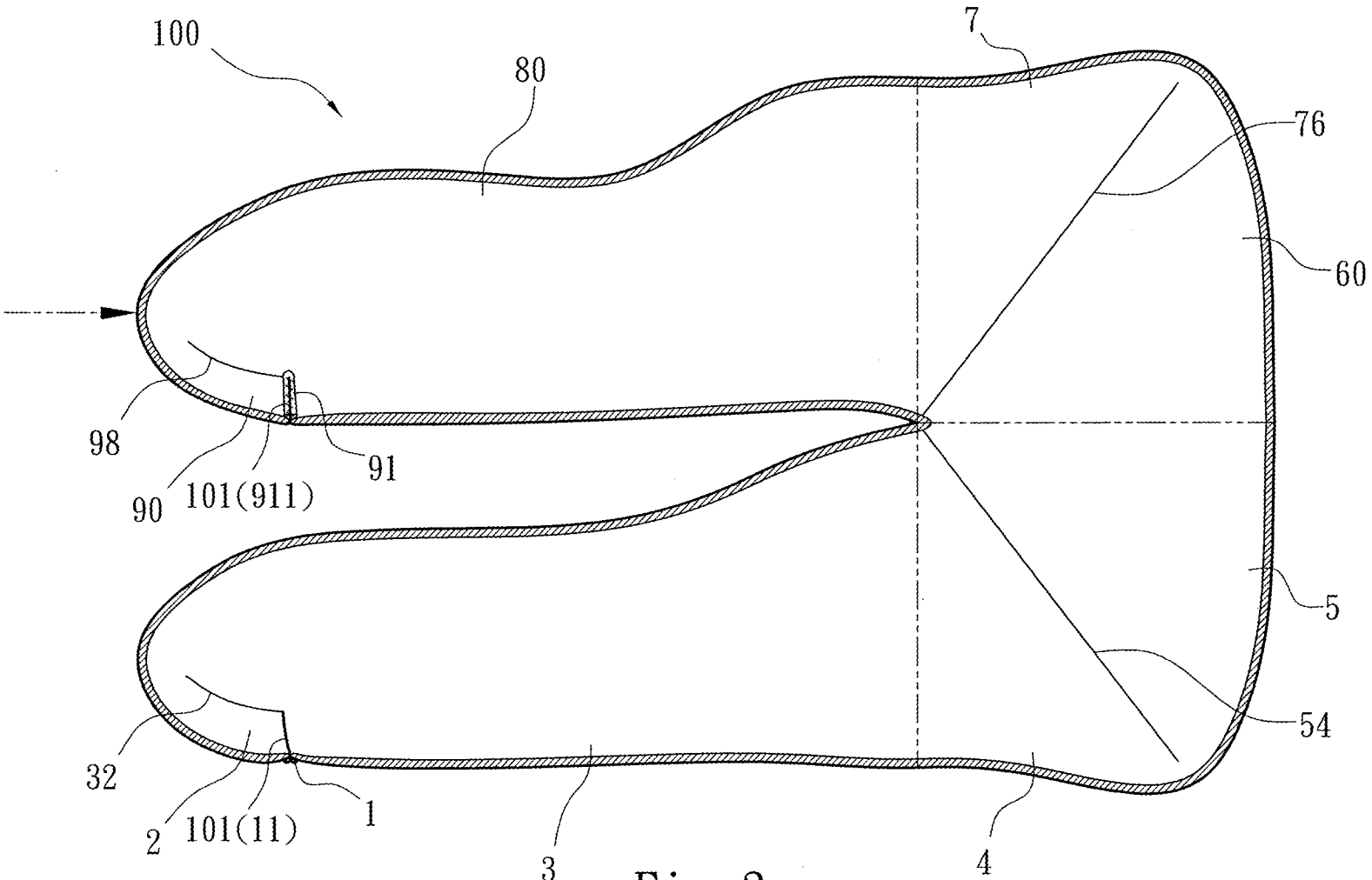
FIG. 3 to FIG. 5 are continuous operation diagrams before processing FIG. 2 of the present invention to a shaped shoe upper.
Figure 4:
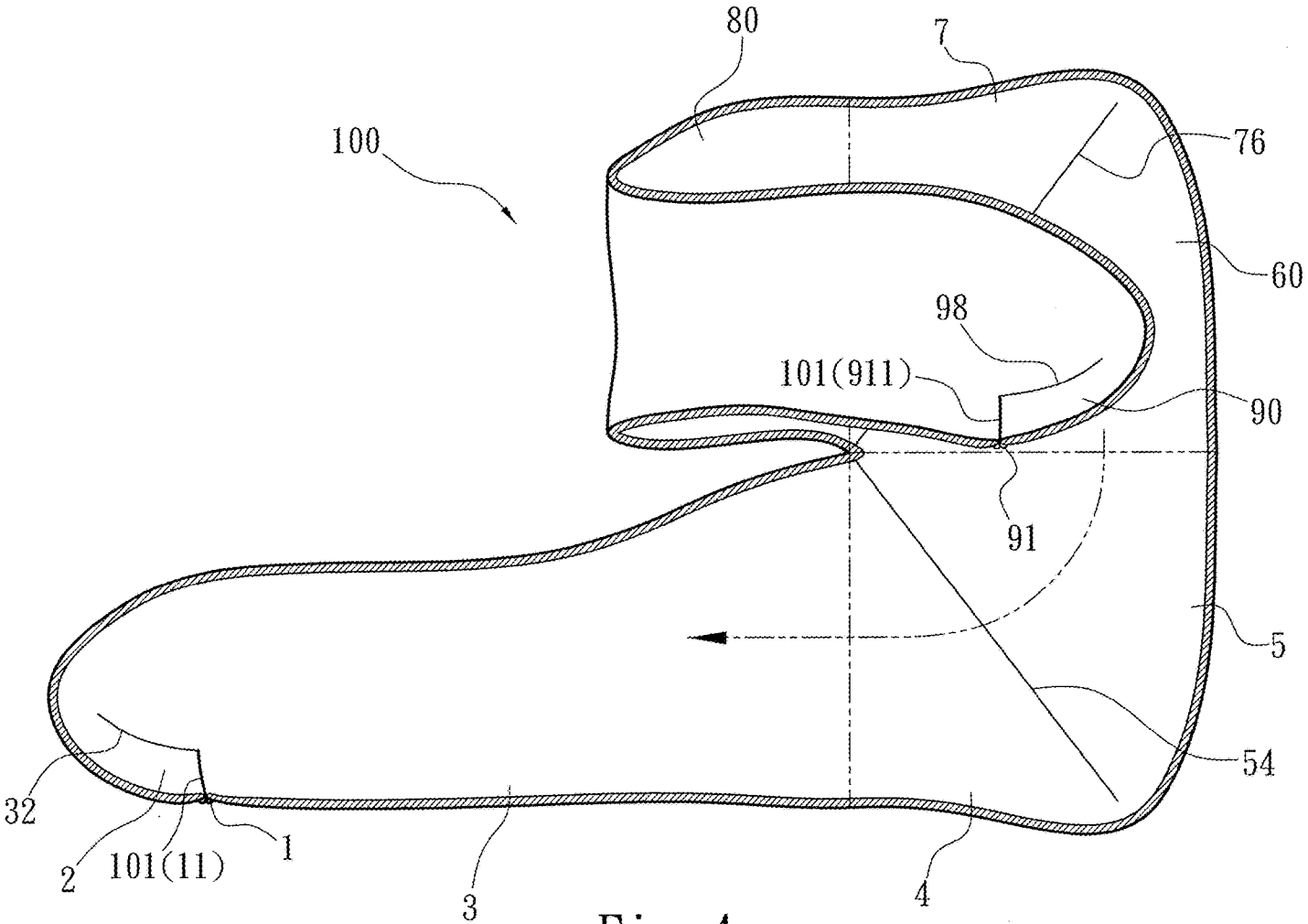
Figure 5:
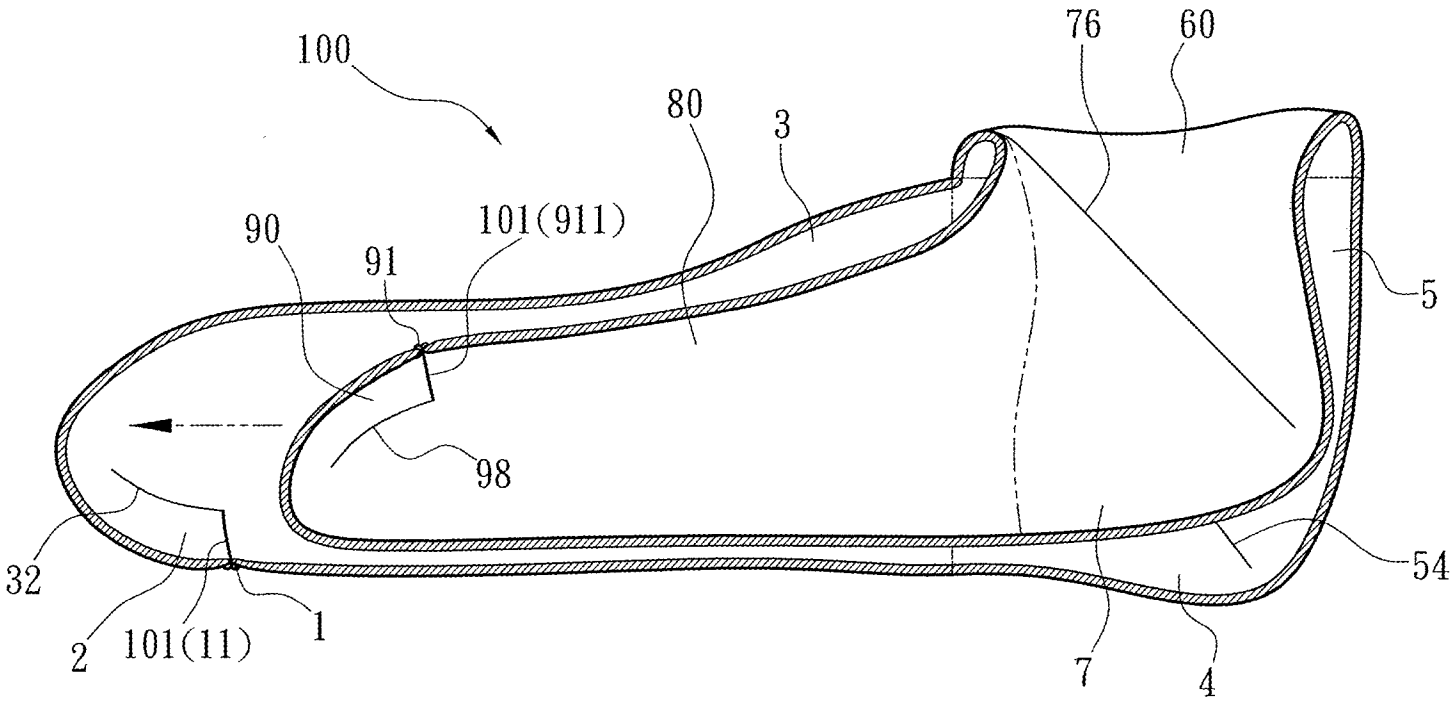
Figure 6:
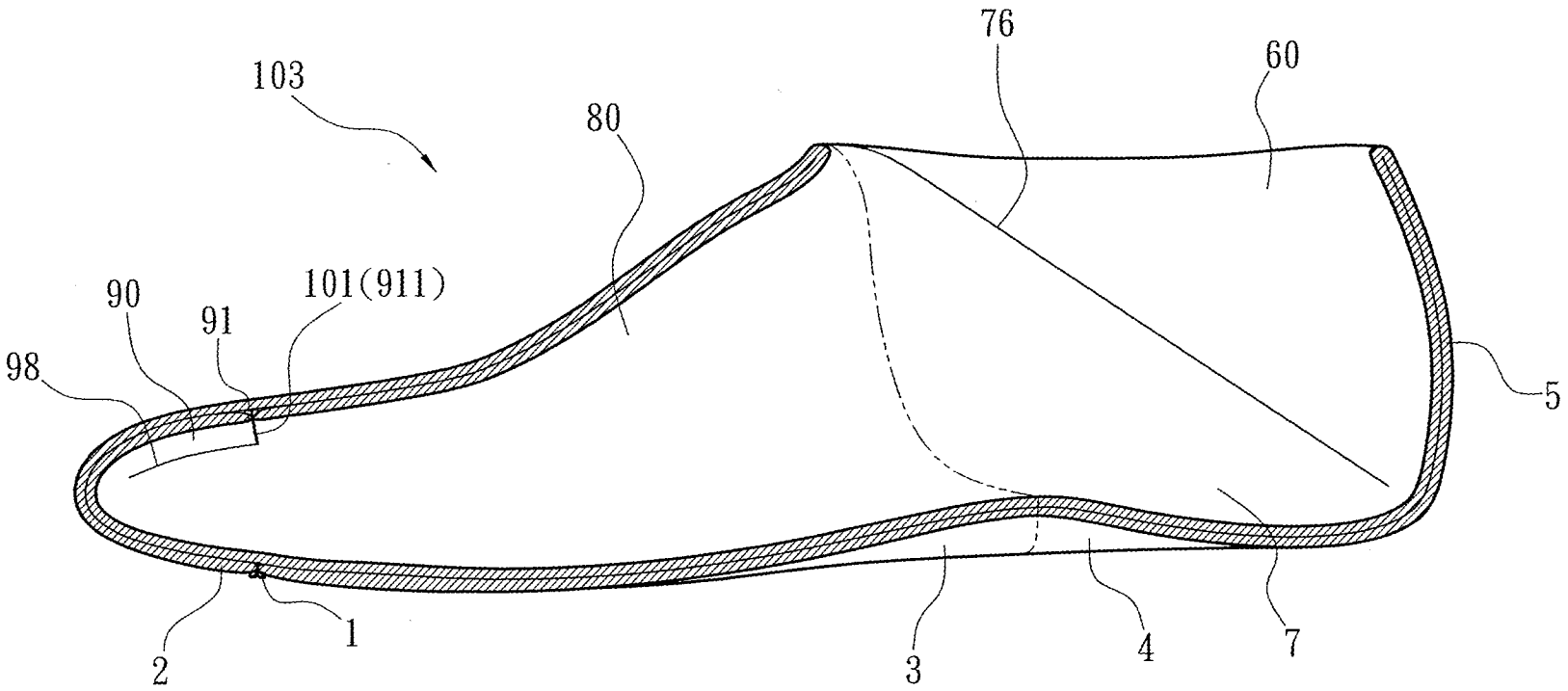
FIG. 6 is a section view of the first preferred embodiment having been processed to a shaped shoe upper.

In step 3, the second toe knitted section 90, the second foot body knitted section 80, the second sole extension section 7 and the second heel knitted section 60 are completely folded in reverse into the integral shoe upper fabric 100 to form a double-layer structure, as shown in FIG. 3 to FIG. 5. In step 4, the inside of the integral shoe upper fabric 100 is applied by a shaping solvent, and the shaping solvent is caused to infuse from an inner layer to an outer layer of the integral shoe upper fabric 100. In step 5, a shoe shape supporting mold is placed in the integral shoe upper fabric 100. In step 6, the inner layer and the outer layer of the integral shoe upper fabric 100 are glued together and shaped at the same time by a temperature-controlled heating method. In step 7, the shoe shape supporting mold is taken out of the integral shoe upper fabric 100, and the shaped shoe upper 103 is formed, as shown in FIG. 6. The above-mentioned steps for processing the integral shoe upper fabric 100 into the shaped shoe upper 103 are not the subject matter of the application, and are not further discussed in detail. Associated processing steps or technologies may be referred from the disclosure of the Taiwan Patent Publication No. 201514353.

Figure 7:
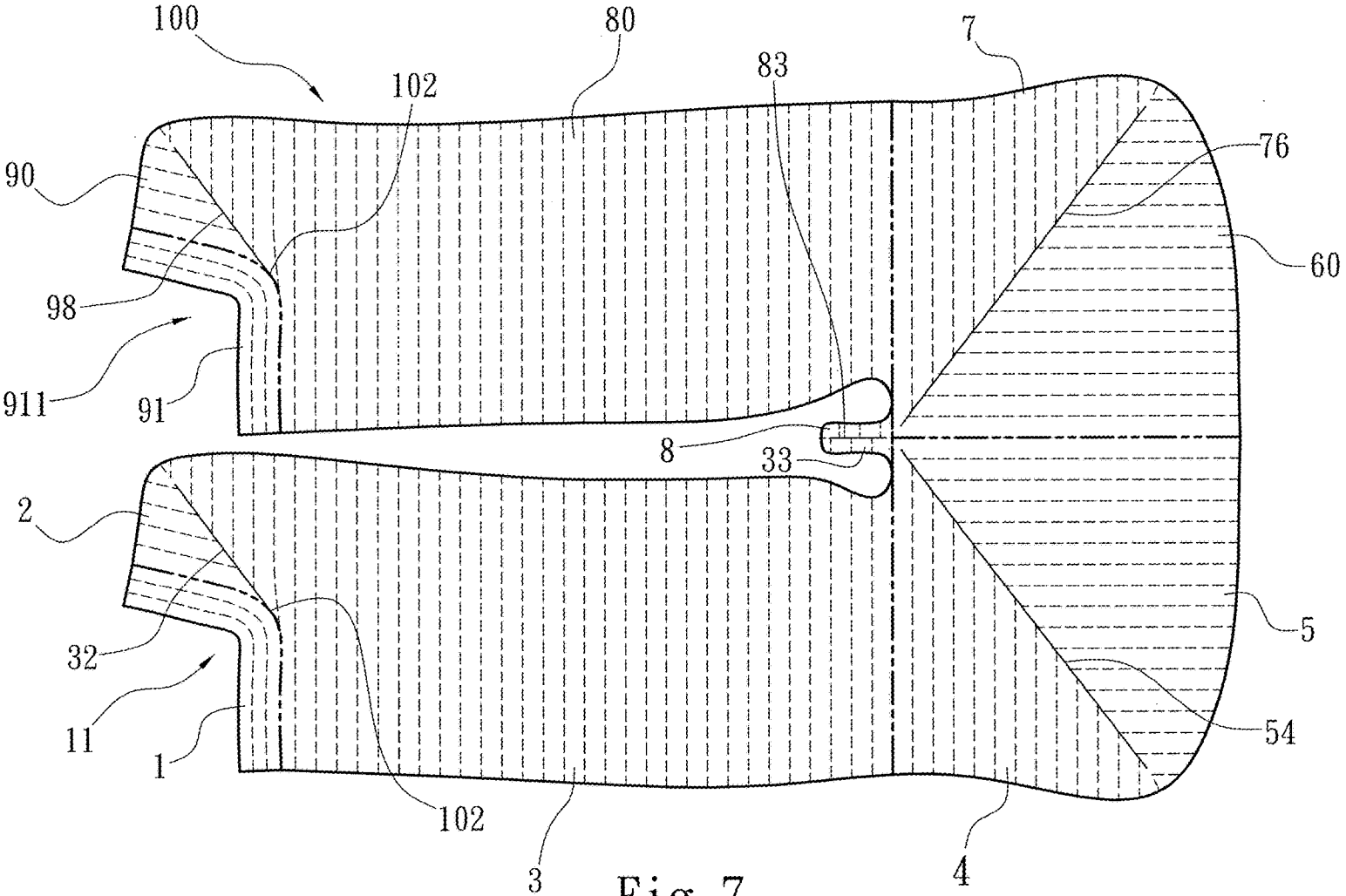
FIG. 7 is a planar appearance schematic diagram according to a second preferred embodiment of the present invention.
Figure 8:
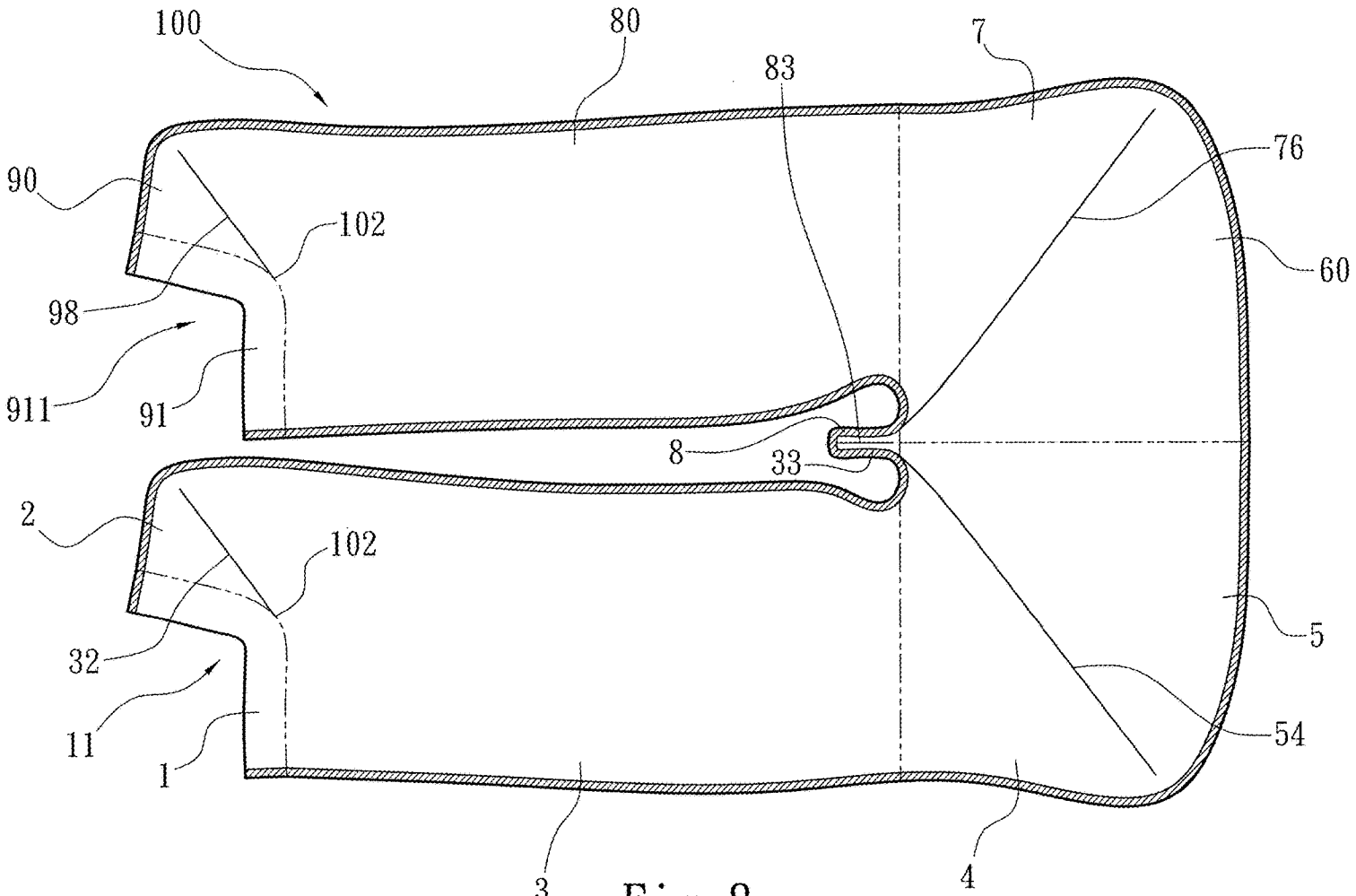
FIG. 8 is a section view of FIG. 7.
Figure 9:
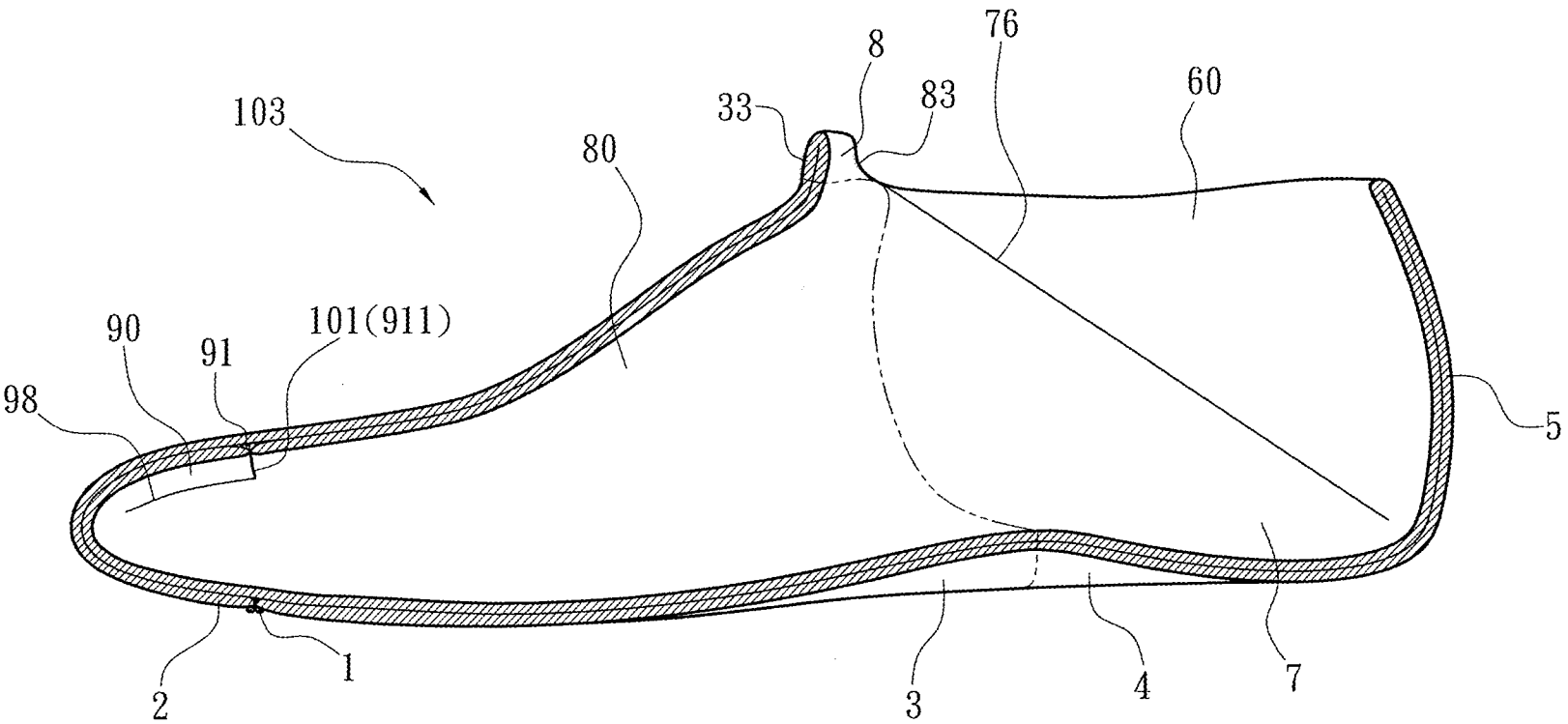
FIG. 9 is a section view of the second preferred embodiment having been processed to a shaped shoe upper.

Refer to FIG. 7 to FIG. 9 showing planar appearance and section diagrams according to a second preferred embodiment of the present invention, and a section view of the second preferred embodiment having been processed to a shaped shoe upper. It is clearly seen from the diagrams that, a variation of the second preferred embodiment of the present invention compared to the first preferred embodiment of the present invention is that, the integral shoe upper fabric 100 further includes a first instep extension section 33 located at an upper edge side of the first foot body knitted section 3 and knitted by the circular knitting machine, and a second instep extension section 8 located at a turning side of the first instep extension section 33 and knitted by the circular knitting machine, with an instep extension turning interknitting line 83 formed between the first instep extension section 33 and the second instep extension section 8. It should be noted that, the first opening 11 before having been sutured is as shown in FIG. 25, and may form a suture line 101 appearing as an inverted T, an inverted Y or a horizontal I after having been sutured, as shown in FIG. 26 to FIG. 28. Further, after the suture line 101 is formed, the first reserved suture section 1 may be appropriately trimmed as shown in FIG. 7 to FIG. 9. Further, the second opening 911 may form another suture line 101 appearing as an inverted T, an inverted Y or a horizontal I after having been sutured, and may be appropriately trimmed as shown in FIG. 7 to FIG. 9 after the suture line 101 is formed. To better explain the present invention, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section 1 including a first opening 11 from the yarn; operating the circular knitting machine to knit a first toe knitted section 2 in continuation from an upper edge of the first reserved suture section 1; operating the circular knitting machine to turn the knitting direction from the first toe knitted section 2, combine a lower edge of the first reserved suture section 1, and knit in continuation to form a first foot body knitted section 3, with a first toe turning interknitting line 32 interknitted between the first toe knitted section 2 and the first foot body knitted section 3; operating the circular knitting machine to knit a first instep extension section 33 in continuation from an upper edge of the first foot body knitted section 3; operating the circular knitting machine to knit a first sole extension section 4 in continuation from a lower edge of the first foot body knitted section 3; operating the circular knitting machine to turn the knitting direction from the first sole extension section 4, and sequentially knit a first heel knitted section 5 and a second heel knitted section 60, with a first heel turning interknitting line 54 interknitted between the first sole extension section 4 and the first heel knitted section 5; operating the circular knitting machine to turn the knitting direction from the second heel knitted section 60, and knit a second sole extension section 7, with a second heel turning interknitting line 76 interknitted between the second heel knitted section 60 and the second sole extension section 7 and symmetric to the first heel turning interknitting line 54; operating the circular knitting machine to turn the knitting direction, and knit a second instep extension section 8 in continuation from the first instep extension section 33, with an instep extension turning interknitting line 83 interknitted between the first instep extension section 33 and the second instep extension section 8; operating the circular knitting machine to combine and knit in continuation from an edge of the second sole extension section 7 and an edge of the second instep extension section 8 to form a second foot body knitted section 80; operating the circular knitting machine to knit in continuation from an upper edge of the second foot body knitted section 80, turn the knitting direction, and knit a second toe knitted section 90, with a second toe turning interknitting line 98 interknitted between the second foot body knitted section 80 and the second toe knitted section 90; and operating the circular knitting machine to combine and knit in continuation from an edge of the second toe knitted section 90 and a lower edge of the second foot body knitted section 80 to form a second reserved suture section 91 including a second opening 911 that is asymmetric to the direction of the first opening 11 of the first reserved suture section 1.

Figure 10:
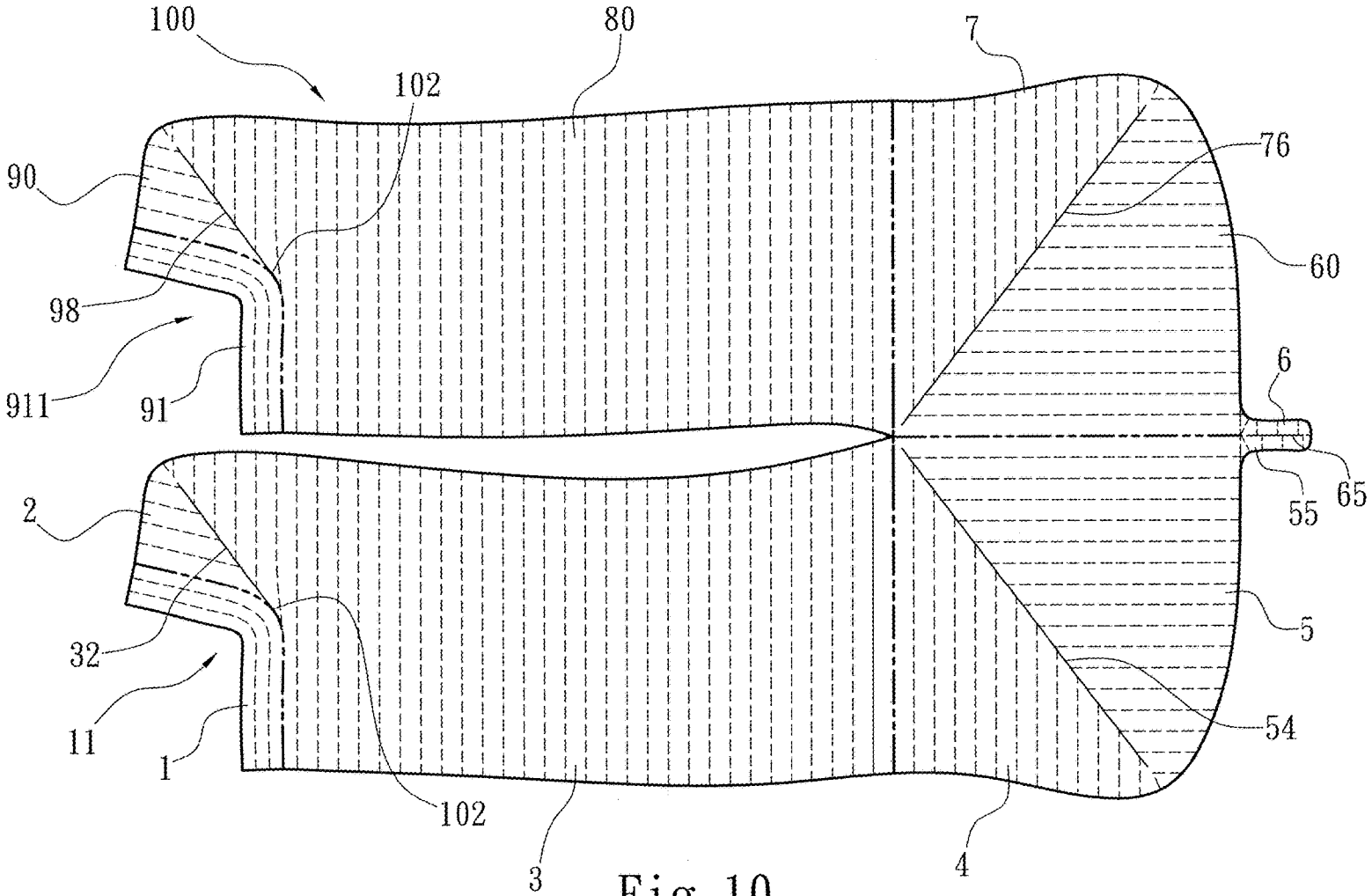
FIG. 10 is a planar appearance schematic diagram according to a third preferred embodiment of the present invention.
Figure 11:
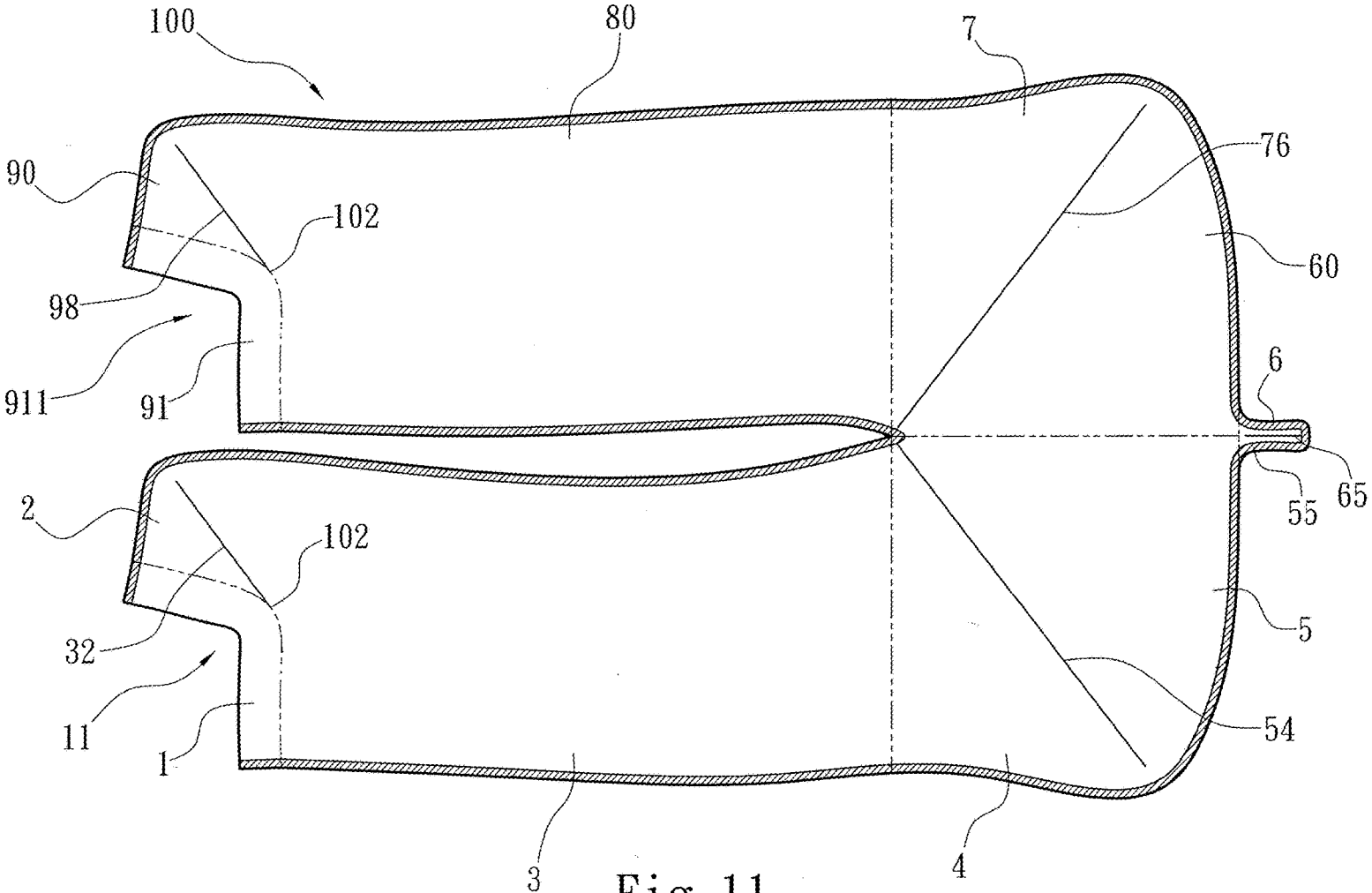
FIG. 11 is a section view of FIG. 10.
Figure 12:
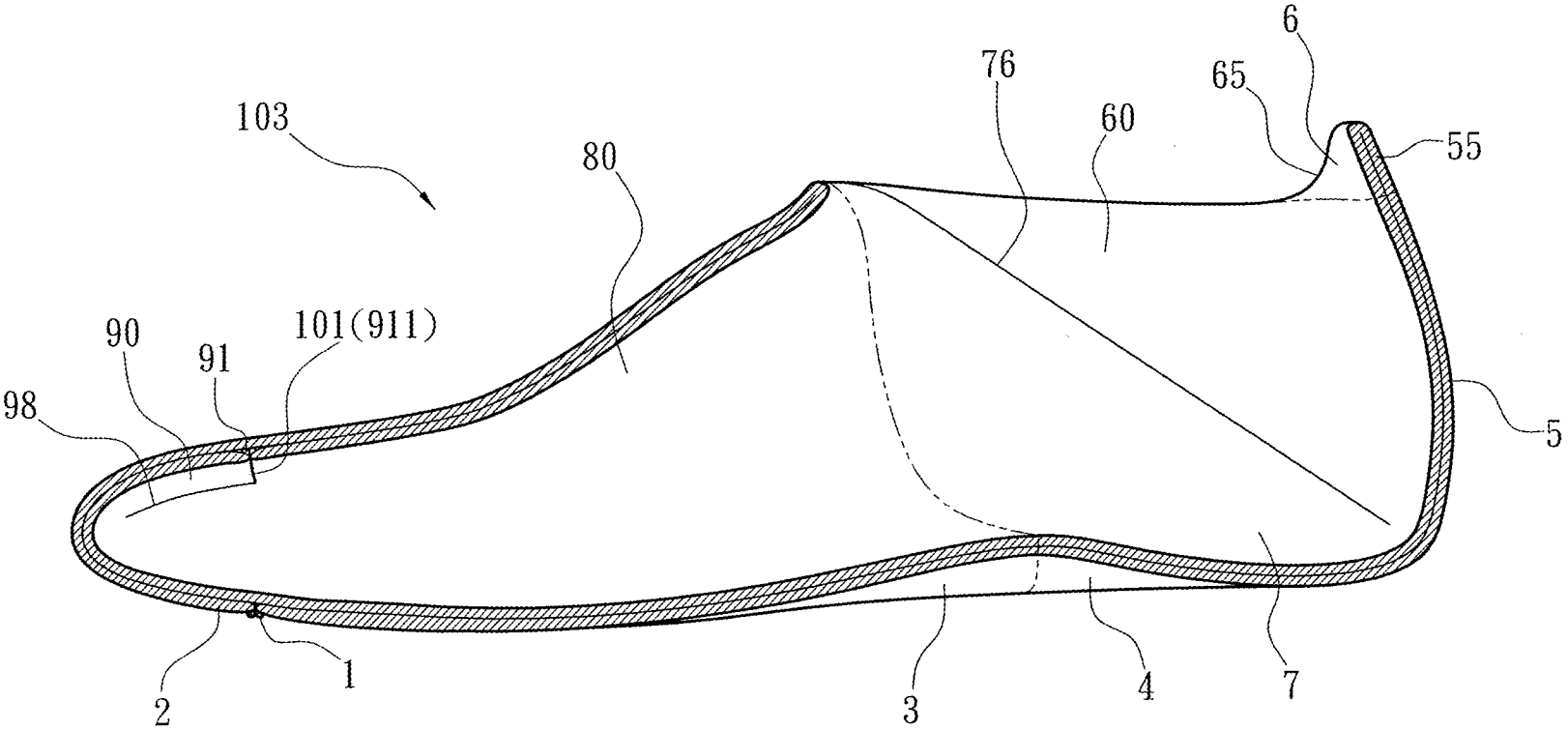
FIG. 12 is section view of the third preferred embodiment having been processed to a shaped shoe upper.

Refer to FIG. 10 to FIG. 12 showing planar appearance and section diagrams according to a third preferred embodiment of the present invention, and a section view of the third preferred embodiment having been processed to a shaped shoe upper. It is clearly seen from the diagrams that, a variation of the third preferred embodiment of the present invention compared to the first preferred embodiment of the present invention is that, the integral shoe upper fabric 100 further includes at least one first heel extension section 55 located at a lower edge of the first heel knitted section 5 and knitted by the circular knitting machine, and at least one second heel extension section 6 located at a turning side of the first heel extension section 55 and knitted by the circular knitting machine, with at least one heel extension turning interknitting line 65 formed between the first heel extension section 55 and the second heel extension section 6. It should be noted that, the first opening 11 before having been sutured is as shown in FIG. 25, and may form a suture line 101 appearing as an inverted T, an inverted Y or a horizontal I after having been sutured, as shown in FIG. 26 to FIG. 28. Further, after the suture line 101 is formed, the first reserved suture section 1 may be appropriately trimmed as shown in FIG. 10 to FIG. 12. Further, the second opening 911 may form another suture line 101 appearing as an inverted T, an inverted Y or a horizontal I after having been sutured, and may be appropriately trimmed as shown in FIG. 10 to FIG. 12 after the suture line 101 is formed. To better explain the present invention, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section 1 including a first opening 11 from the yarn; operating the circular knitting machine to knit a first toe knitted section 2 in continuation from an upper edge of the first reserved suture section 1; operating the circular knitting machine to turn the knitting direction from the first toe knitted section 2, combine a lower edge of the first reserved suture section 1, and knit in continuation to form a first foot body knitted section 3, with a first toe turning interknitting line 32 interknitted between the first toe knitted section 2 and the first foot body knitted section 3; operating the circular knitting machine to knit a first sole extension section 4 in continuation from a lower edge of the first foot body knitted section 3; operating the circular knitting machine to turn the knitting direction from the first sole extension section 4, and knit a first heel knitted section 5 in continuation from the first sole extension section 4, with a first heel turning interknitting line 54 interknitted between the first sole extension section 4 and the first heel knitted section 5; operating the circular knitting machine to knit a first heel extension section 55 in continuation from a lower edge of the first heel knitted section 5; operating the circular knitting machine to turn the knitting direction, and knit a second heel extension section 6 in continuation from the first heel extension section 55, with a heel extension turning interknitting line 65 interknitted between the first heel extension section 55 and the second heel extension section 6; operating the circular knitting machine to combine and knit in continuation from the second heel extension section 6 and a side edge of the first heel knitted section 5 to form a second heel knitted section 60; operating the circular knitting machine to turn the knitting direction from the second heel knitted section 60, and knit a second sole extension section 7, with a second heel turning interknitting line 76 interknitted between the second heel knitted section 60 and the second sole extension section 7 and symmetric to the first heel turning interknitting line 54; operating the circular knitting machine to combine and knit in continuation from an edge of the second sole extension section 7 and an upper edge of the first foot body knitted section 3 to form a second foot body knitted section 80; operating the circular knitting machine to knit in continuation from an upper edge of the second foot body knitted section 80, turn the knitting direction, and knit a second toe knitted section 90, with a second toe turning interknitting line 98 interknitted between the second foot body knitted section 80 and the second toe knitted section 90; and operating the circular knitting machine to combine and knit in continuation from an edge of the second toe knitted section 90 and a lower edge of the second foot body knitted section 80 to form a second reserved suture section 91 including a second opening 911 that is asymmetric to the direction of the first opening 11 of the first reserved suture section 1.

Figure 13:
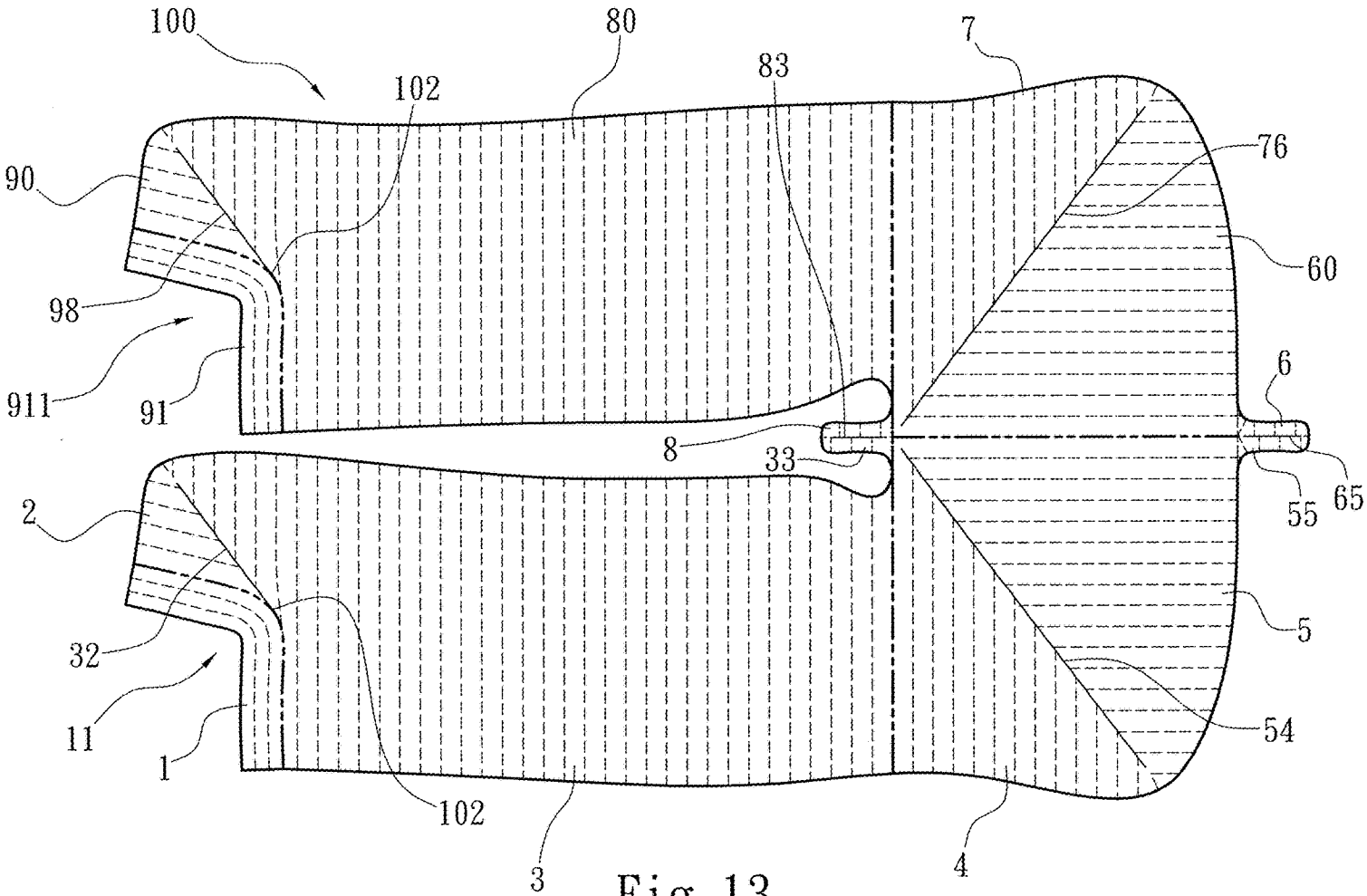
FIG. 13 is a planar appearance schematic diagram according to a fourth preferred embodiment of the present invention.
Figure 14:
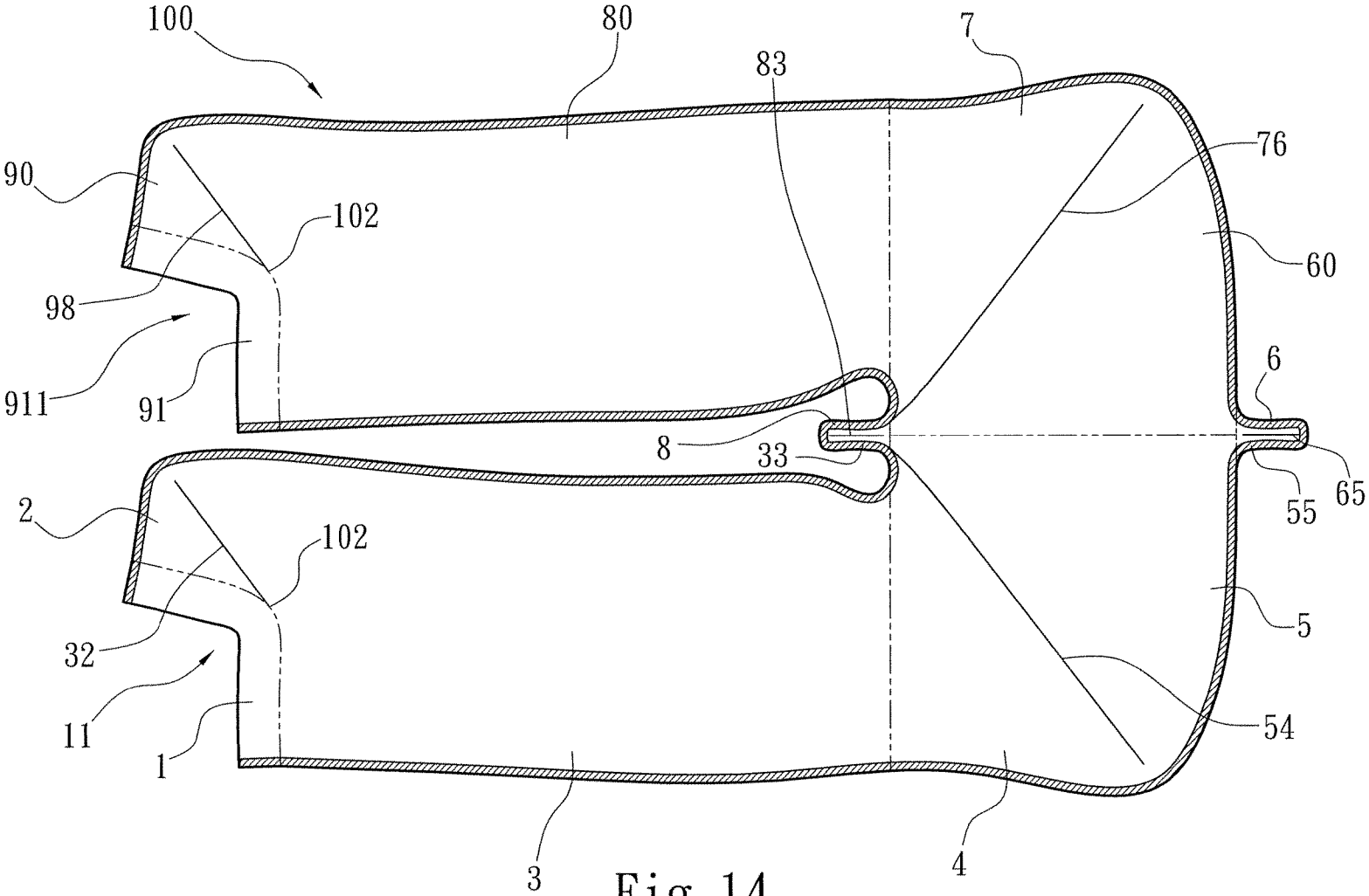
FIG. 14 is a section view of FIG. 13.
Figure 15:
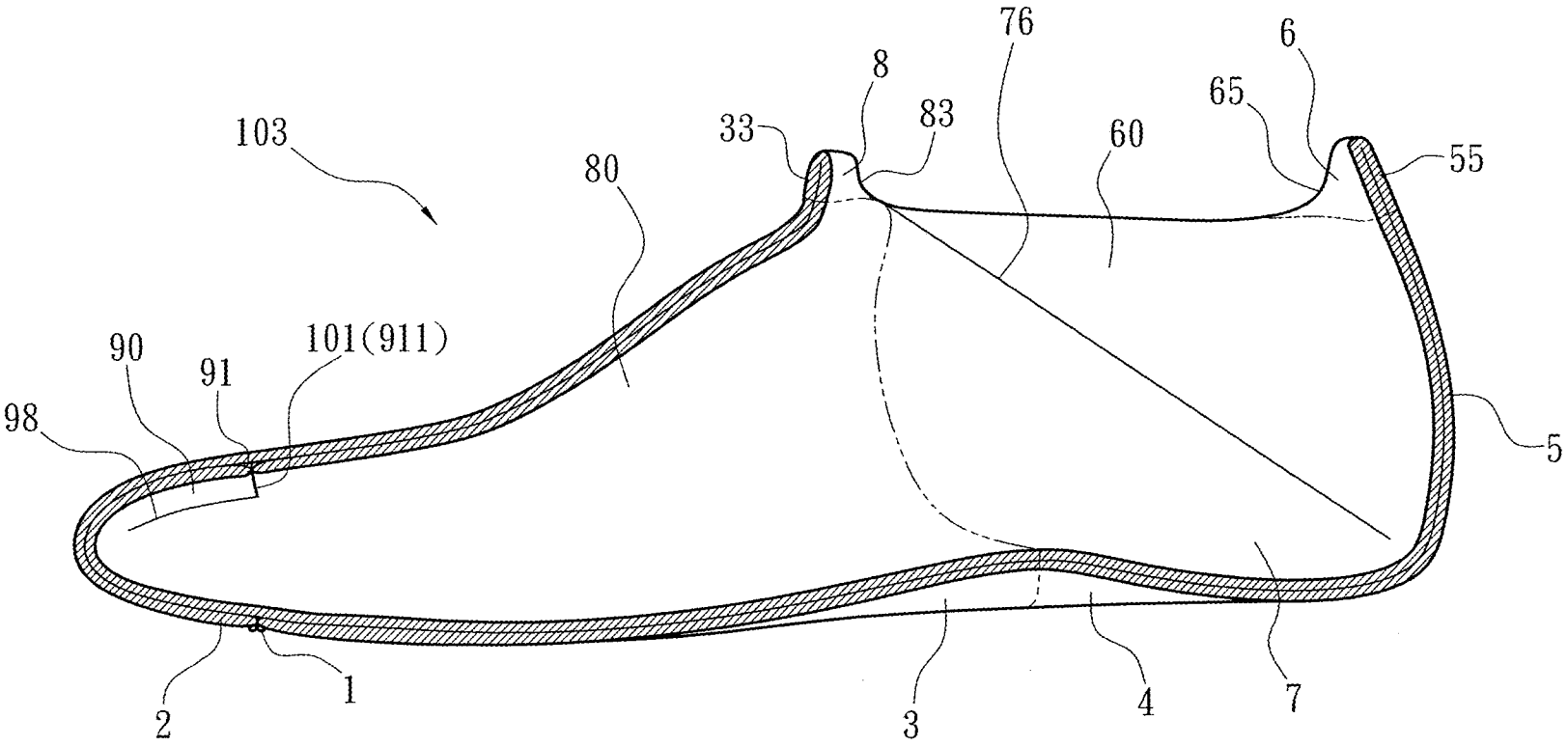
FIG. 15 is a section view of the fourth preferred embodiment having been processed to shaped shoe upper.

Refer to FIG. 13 to FIG. 15 showing planar appearance and section diagrams according to a fourth preferred embodiment of the present invention, and a section view of the fourth preferred embodiment having been processed to a shaped shoe upper. It is clearly seen from the diagrams that, a variation of the fourth preferred embodiment of the present invention compared to the first preferred embodiment of the present invention is that, the integral shoe upper fabric 100 further includes a first instep extension section 33 located at an upper edge side of the first foot body knitted section 3 and knitted by the circular knitting machine, a second instep extension section 8 located at a turning side of the first instep extensions section 33 and knitted by the circular knitting machine, and at an instep extension turning interknitting line 83 formed between the first instep extension section 33 and the second instep extension section 8. The integral shoe upper fabric 100 further includes at least one first heel extension section 55 located at a lower edge of the first heel knitted section 5 and knitted by the circular knitting machine, at least one second heel extension section 6 located at a turning side of the first heel extension section 55 and knitted by the circular knitting machine, and at least one heel extension turning interknitting line 65 formed between the first heel extension section 55 and the second heel extension section 6. It should be noted that, the first opening 11 before having been sutured is as shown in FIG. 25, and may form a suture line 101 appearing as an inverted T, an inverted Y or a horizontal I after having been sutured, as shown in FIG. 26 to FIG. 28. Further, after the suture line 101 is formed, the first reserved suture section 1 may be appropriately trimmed as shown in FIG. 13 to FIG. 15. Further, the second opening 911 may form another suture line 101 appearing as an inverted T, an inverted Y or a horizontal I after having been sutured, and may be appropriately trimmed as shown in FIG. 13 to FIG. 15 after the suture line 101 is formed. To better explain the present invention, the present invention further provides a method for knitting an integral shoe upper fabric by a circular knitting machine. The method includes: providing a circular knitting machine, and providing at least one non-elastic yarn for the circular knitting machine to perform knitting; operating the circular knitting machine to knit a first reserved suture section 1 including a first opening 11 from the yarn; operating the circular knitting machine to knit a first toe knitted section 2 in continuation from an upper edge of the first reserved suture section 1; operating the circular knitting machine to turn the knitting direction from the first toe knitted section 2, combine a lower edge of the first reserved suture section 1, and knit in continuation to form a first foot body knitted section 3, with a first toe turning interknitting line 32 interknitted between the first toe knitted section 2 and the first foot body knitted section 3;

operating the circular knitting machine to knit a first instep extension section 33 in continuation from an upper edge of the first foot body knitted section 3; operating the circular knitting machine to knit a first sole extension section 4 in continuation from a lower edge of the first foot body knitted section 3; operating the circular knitting machine to turn the knitting direction, and knit a first heel knitted section 5 in continuation from the first sole extension section 4, with a first heel turning interknitting line 54 interknitted between the first sole extension section 4 and the first heel knitted section 5; operating the circular knitting machine to knit a first heel extension section 55 in continuation from a lower edge of the first heel knitted section 5; operating the circular knitting machine to turn the knitting direction, and knit a second heel extension section 6 in continuation from the first heel extension section 55, with a heel extension turning interknitting line 65 interknitted between the first heel extension section 55 and the second heel extension section 6; operating the circular knitting machine to combine and knit in continuation from the second heel extension section 6 and a side edge of the first heel knitted section 5 to form a second heel knitted section 60; operating the circular knitting machine to turn the knitting direction from the second heel knitted section 60, and knit a second sole extension section 7, with a second heel turning interknitting line 76 interknitted between the second heel knitted section 60 and the second sole extension section 7 and symmetric to the first heel turning interknitting line 54; operating the circular knitting machine to turn the knitting direction, and knit a second instep extension section 8 in continuation from the first instep extension section 33, with an instep extension turning interknitting line 83 interknitted between the first instep extension section 33 and the second instep extension section 8; operating the circular knitting machine to combine and knit in continuation from an edge of the second sole extension section 7 and an edge of the second instep extension section 8 to form a second foot body knitted section 80; operating the circular knitting machine knit in continuation from an upper edge of the second foot body knitted section 80, and turn the knitting direction, knit a second toe knitted section 90, with a second toe turning interknitting line 98 interknitted between the second foot body knitted section 80 and the second toe knitted section 90; and operating the circular knitting machine to combine and knit in continuation from an edge of the second toe knitted section 90 and a lower edge of the second foot body knitted section 80 to form a second reserved suture section 91 including a second opening 911 that is asymmetric to the direction of the first opening 11 of the first reserved suture section 1.

Figure 16:
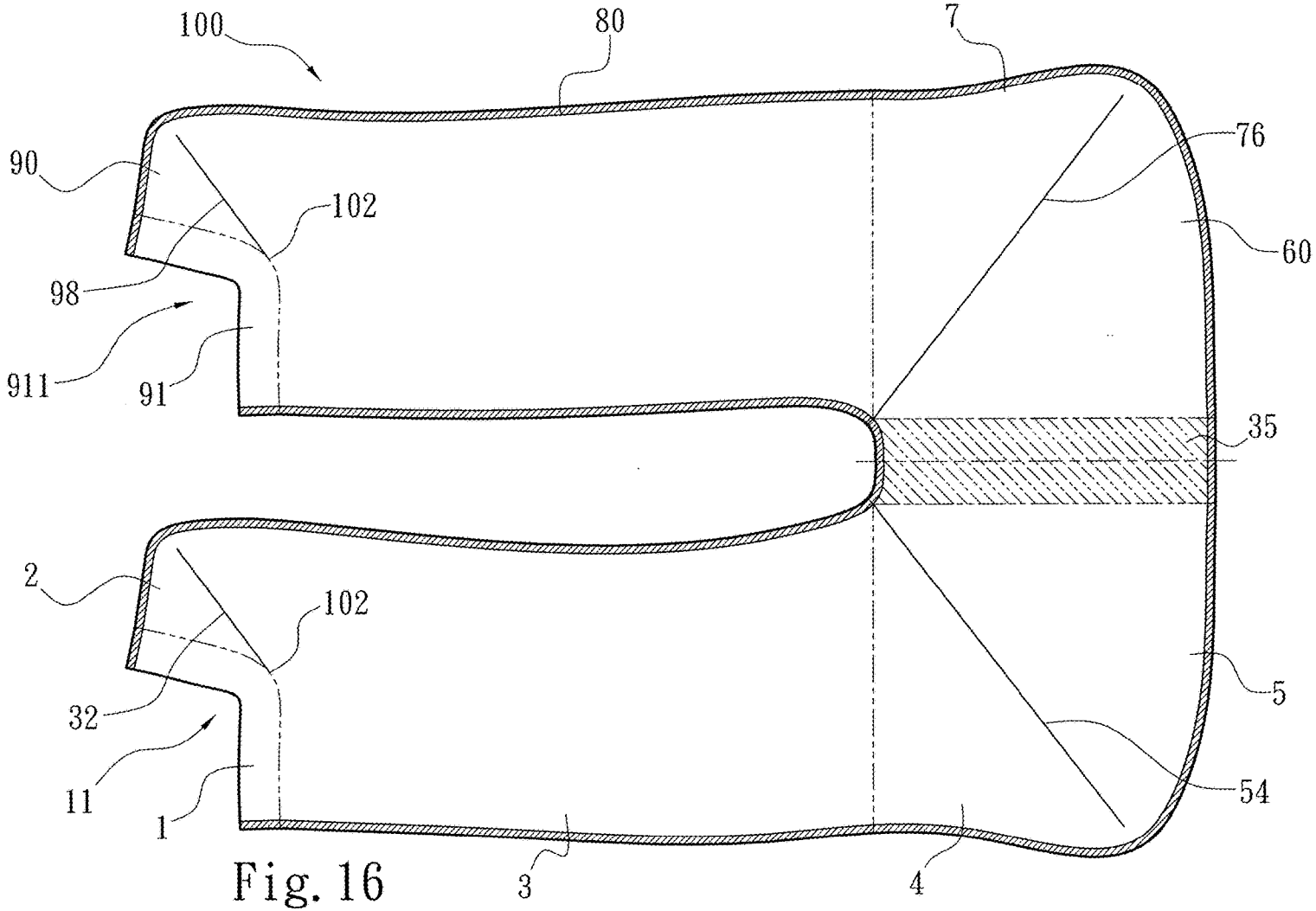
FIG. 16 is a planar section view according to a fifth preferred embodiment of the present invention.
Figure 17:
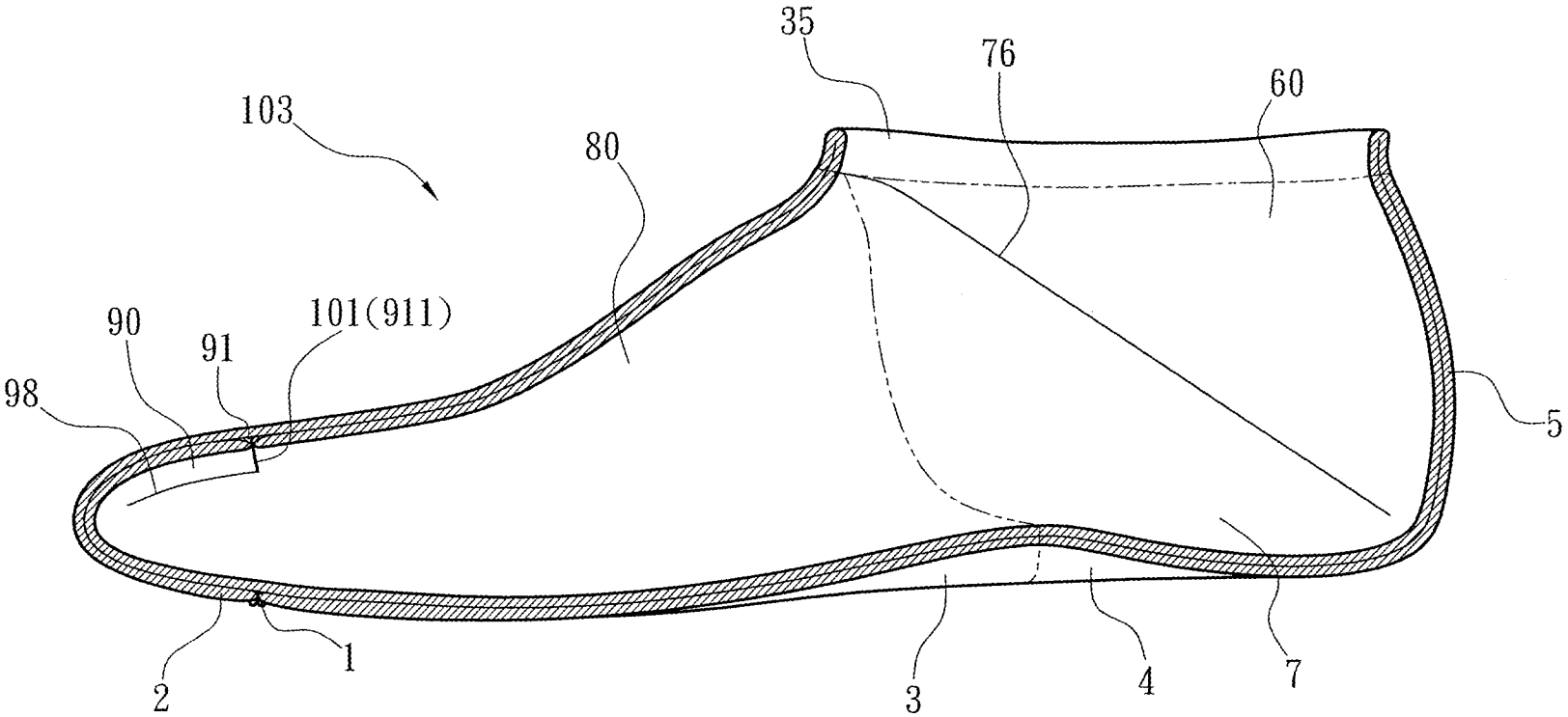
FIG. 17 is a section view of a first pattern of the fifth preferred embodiment having been processed to shaped shoe upper.
Figure 18:
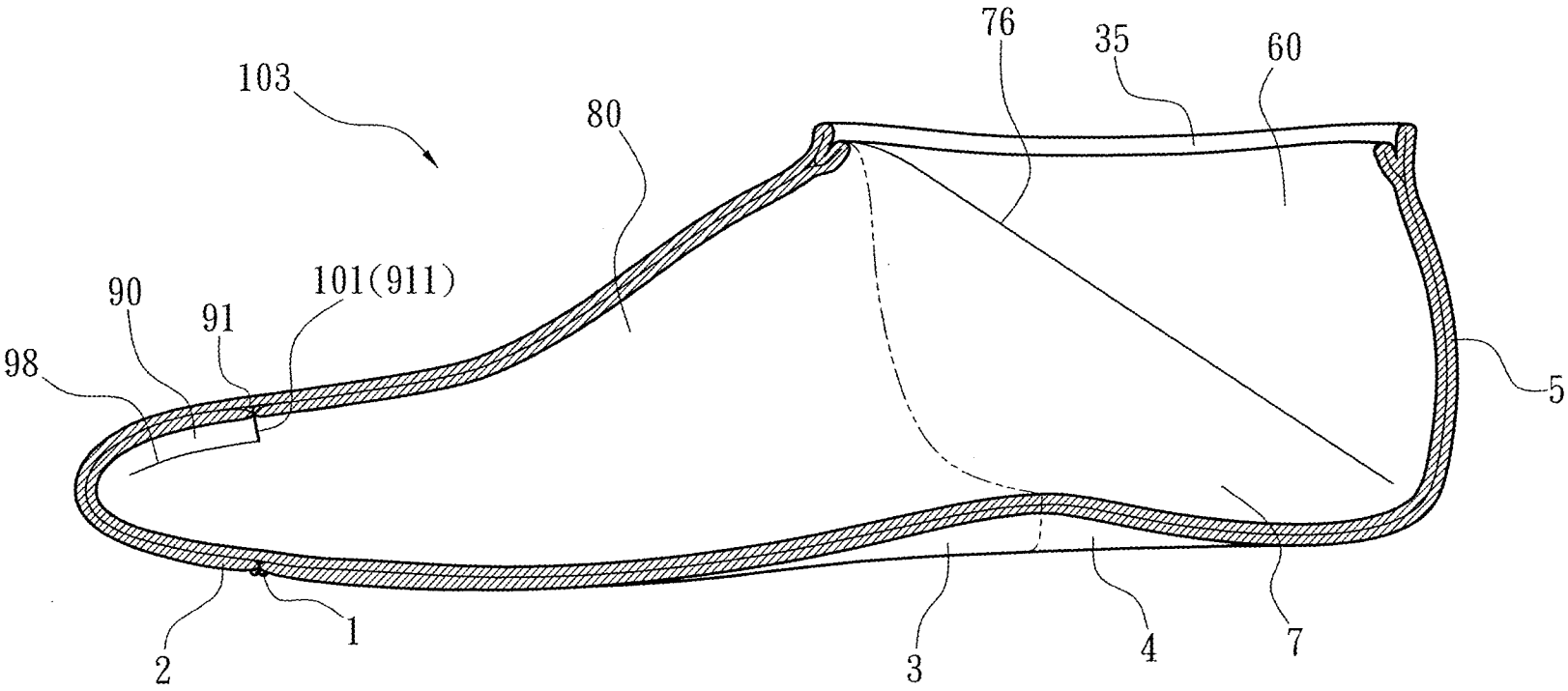
FIG. 18 is a section view of a second pattern of the fifth preferred embodiment having been processed to shaped shoe upper.

Refer to FIG. 16 to FIG. 17 showing a section view according to a fifth preferred embodiment of the present invention, and a section view of a first pattern of the fifth preferred embodiment having been processed to a shaped shoe upper. It is clearly seen from the diagrams that, a variation of the fifth preferred embodiment of the present invention compared to the first preferred embodiment of the present invention is that, the integral shoe upper fabric 100 further includes a reinforcing additional section 35, which is located between the first heel knitted section 5 and the second heel knitted section 60, and is knitted by the circular knitting machine. The first pattern can be formed by directly folding the reinforcing additional section 35 by half FIG. 18 shows a section view of a second pattern of the fifth preferred embodiment having been processed to a shaped shoe upper. A variation of the second pattern compared to the first pattern is that, when a center line of the reinforcing additional section 35 of the first pattern is pressed and becomes recessed, the shape of the reinforcing additional section 35 as shown by the second pattern can be formed. It should be noted that, the first opening 11 before having been sutured is as shown in FIG. 25, and may form a suture line 101 appearing as an inverted T, an inverted Y or a horizontal I after having been sutured, as shown in FIG. 26 to FIG. 28. Further, after the suture line 101 is formed, the first reserved suture section 1 may be appropriately trimmed as shown in FIG. 16 and FIG. 17. Further, the second opening 911 may form another suture line 101 appearing as an inverted T, an inverted Y or a horizontal I after having been sutured, and may be appropriately trimmed as shown in FIG. 16 and FIG. 17 after the suture line 101 is formed.

Figure 19:
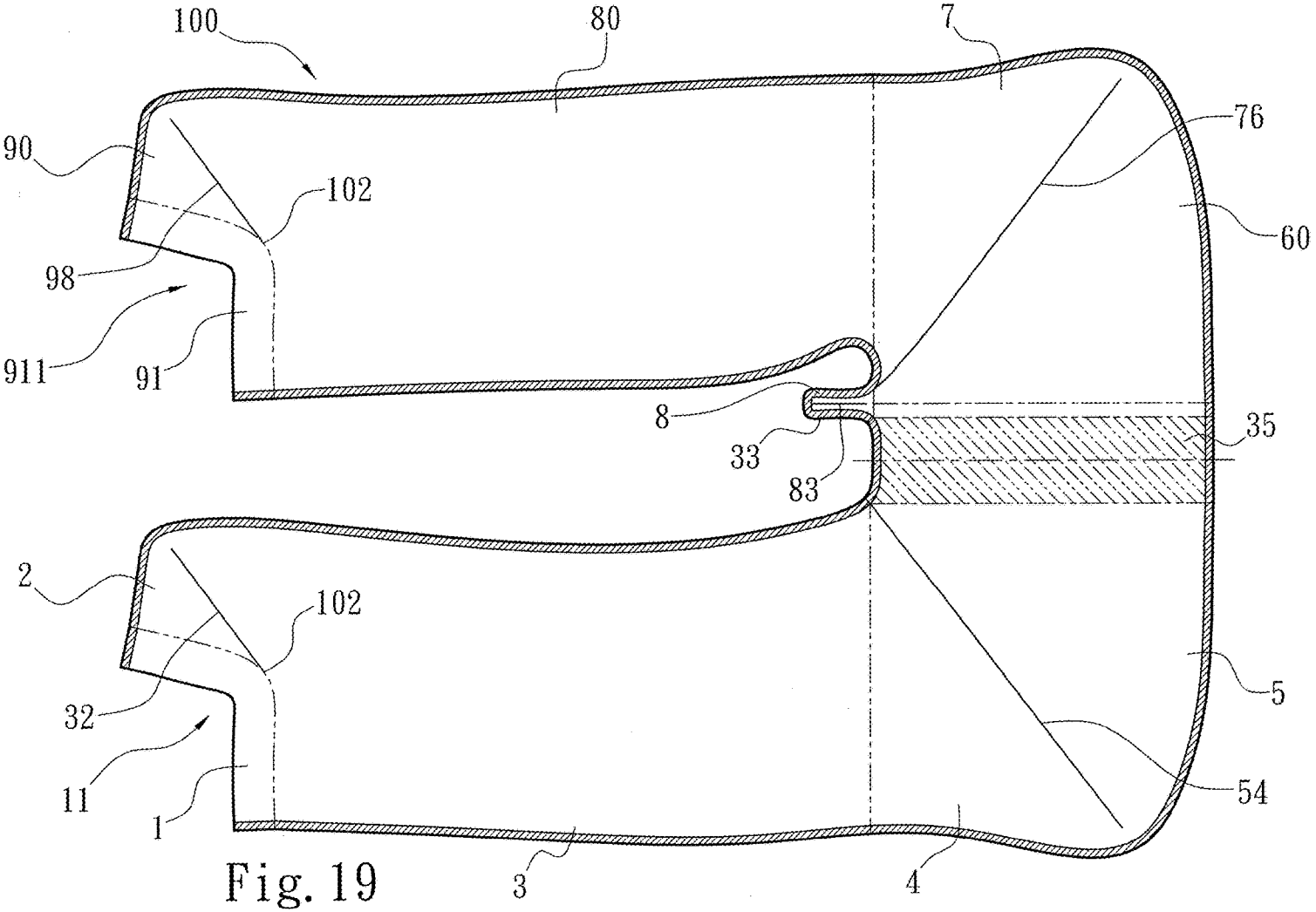
FIG. 19 is a planar section view according to a sixth preferred embodiment of the present invention.
Figure 20:
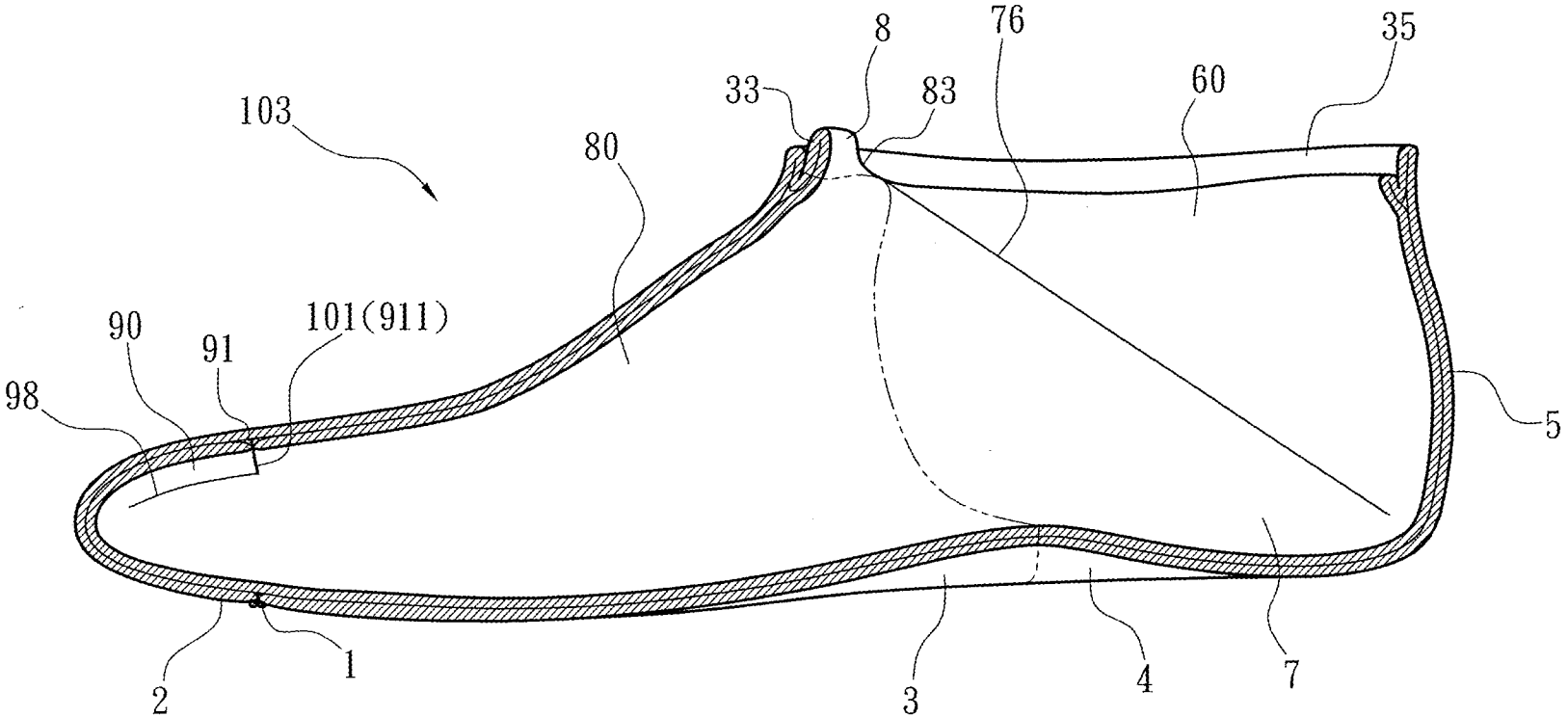
FIG. 20 is a section view of the sixth preferred embodiment having been processed to a shaped shoe upper.

Refer to FIG. 19 to FIG. 20 showing a section view according to a sixth preferred embodiment of the present invention, and a section view of the sixth preferred embodiment having been processed to a shaped shoe upper. It is clearly seen from the diagrams that, a variation of the sixth preferred embodiment of the present invention compared to the second preferred embodiment of the present invention is that, the integral shoe upper fabric 100 further includes a reinforcing additional section 35, which is located between the first foot body knitted section 3 and the first instep extension section 33 and knitted by the circular knitting machine. The circular knitting machine may additionally employ an elastic yarn to knit the reinforcing additional section 35. When the integral shoe upper fabric 100 is folded in reverse along the instep extension turning interknitting line 83 as a reference line, and the reinforcing additional section 35 between the centerline of the reinforcing additional section 35 and the first instep extension section 33 is pressed to become recessed, the integral shoe upper fabric 100 becomes a form shown in FIG. 20. It should be noted that, the first opening 11 before having been sutured is as shown in FIG. 25, and may form a suture line 101 appearing as an inverted T, an inverted Y or a horizontal I after having been sutured, as shown in FIG. 19 and FIG. 20. Further, after the suture line 101 is formed, the first reserved suture section 1 may be appropriately trimmed as shown in FIG. 13 to FIG. 15. Further, the second opening 911 may form another suture line 101 appearing as an inverted T, an inverted Y or a horizontal I after having been sutured, and may be appropriately trimmed as shown in FIG. 19 and FIG. 20 after the suture line 101 is formed.

Figure 21:
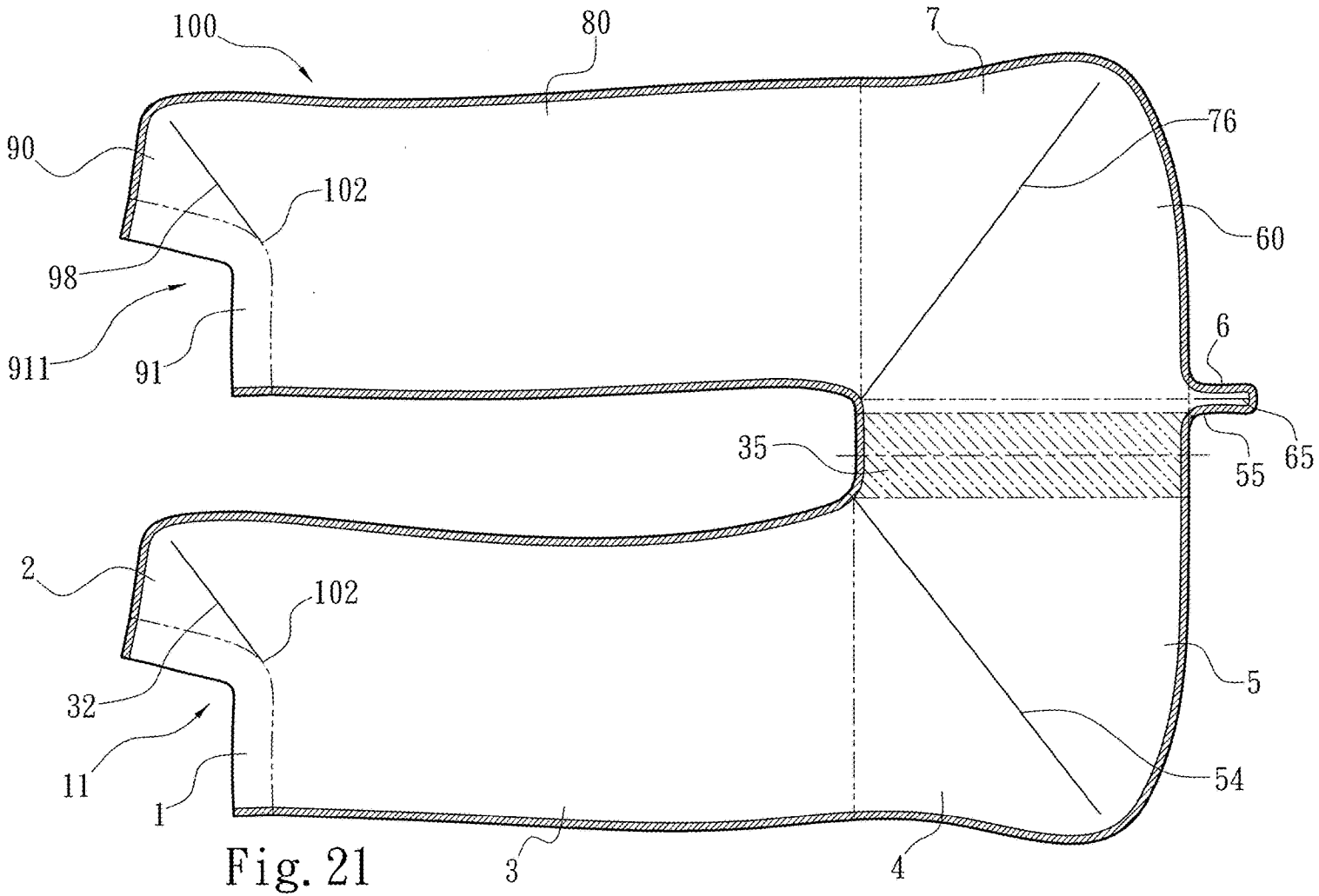
FIG. 21 is a planar section view according to a seventh preferred embodiment of the present invention.
Figure 22:
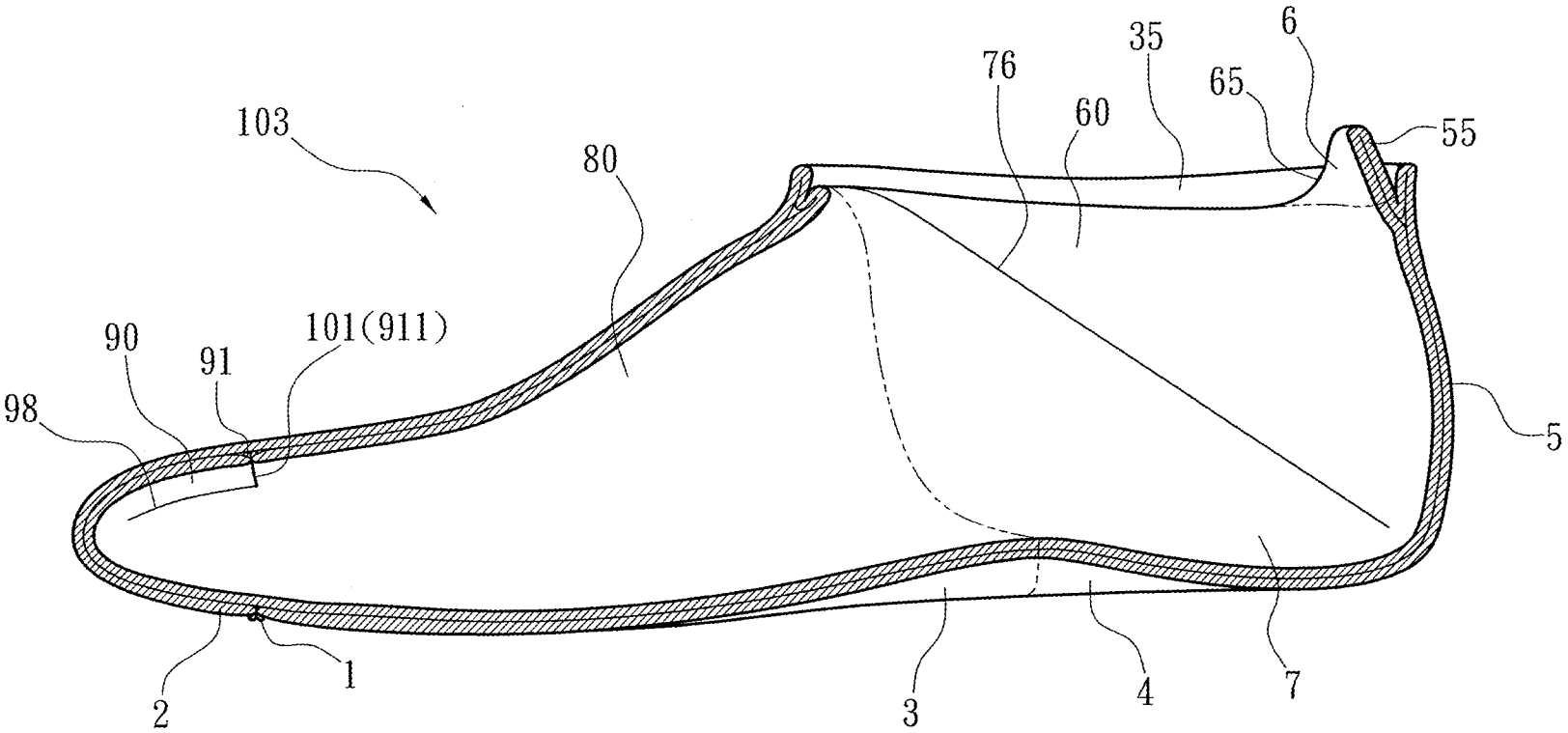
FIG. 22 is a section view of the seventh preferred embodiment having been processed to a shaped shoe upper.

Refer to FIG. 21 and FIG. 22 showing a section view according to a seventh preferred embodiment of the present invention, and a section view of the seventh preferred embodiment having been processed to a shaped shoe upper. It is clearly seen from the diagrams that, a variation of the seventh preferred embodiment of the present invention compared to the third preferred embodiment of the present invention is that, the integral shoe upper fabric 100 further includes a reinforcing additional section 35, which is located between the first heel knitted section 5 and the first heel extension section 55 and is knitted by the circular knitting machine. The round knitting machine may additionally employ an elastic yarn to knit the reinforcing additional section 35. When the integral shoe upper fabric 100 is folded in reverse along heel extension turning interknitting line 65 as a reference line, and the reinforcing additional section 35 between the centerline of the reinforcing additional section 35 and the first heel extension section 55 is pressed to become recessed, the integral shoe upper fabric 100 becomes a form shown in FIG. 22. It should be noted that, the first opening 11 before having been sutured is as shown in FIG. 25, and may form a suture line 101 appearing as an inverted T, an inverted Y or a horizontal I after having been sutured, as shown in FIG. 21 and FIG. 22. Further, after the suture line 101 is formed, the first reserved suture section 1 may be appropriately trimmed as shown in FIG. 13 to FIG. 15. Further, the second opening 911 may form another suture line 101 appearing as an inverted T, an inverted Y or a horizontal I after having been sutured, and may be appropriately trimmed as shown in FIG. 21 and FIG. 22 after the suture line 101 is formed.

Figure 23:
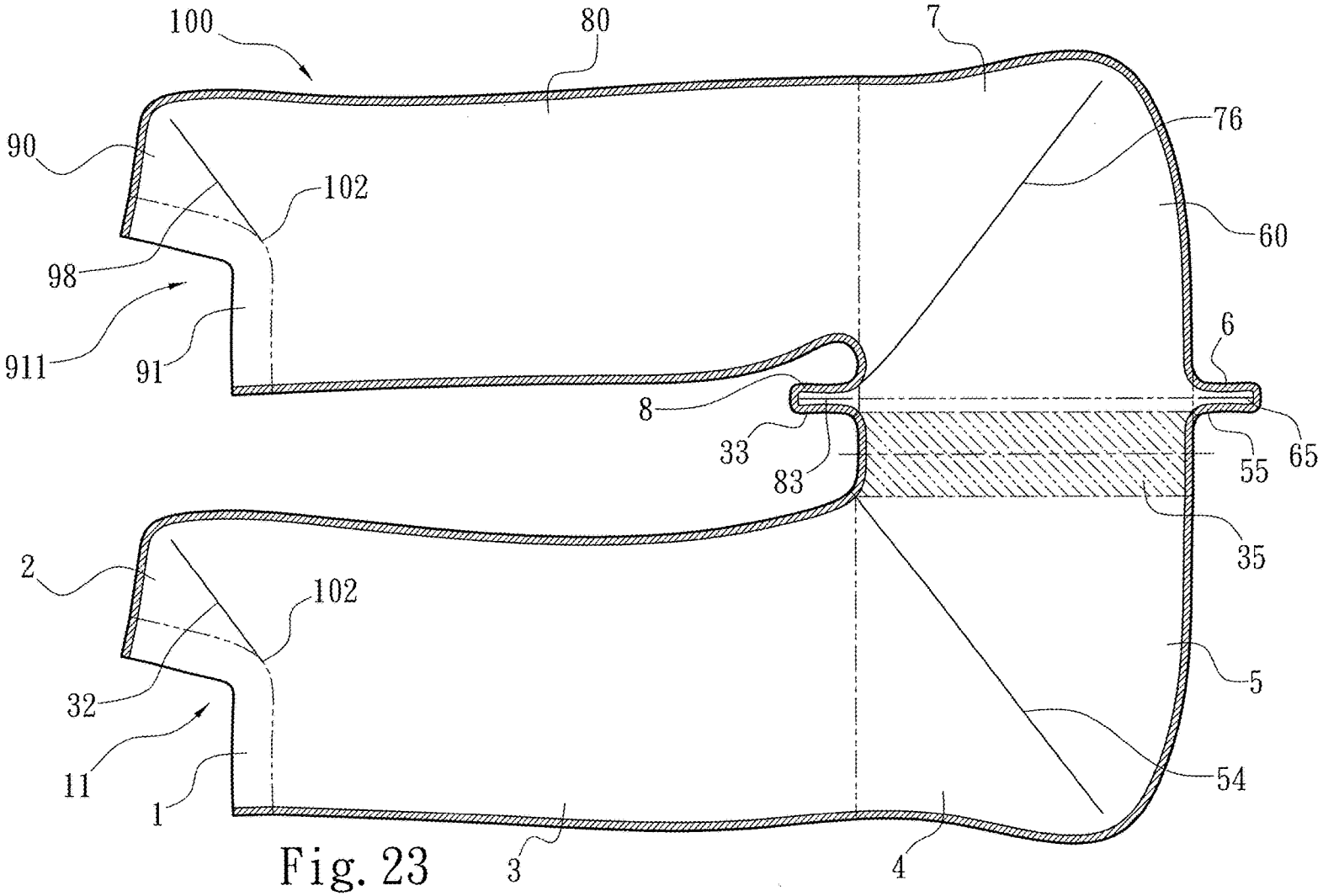
FIG. 23 is a planar section view according to an eighth preferred embodiment of the present invention.
Figure 24:
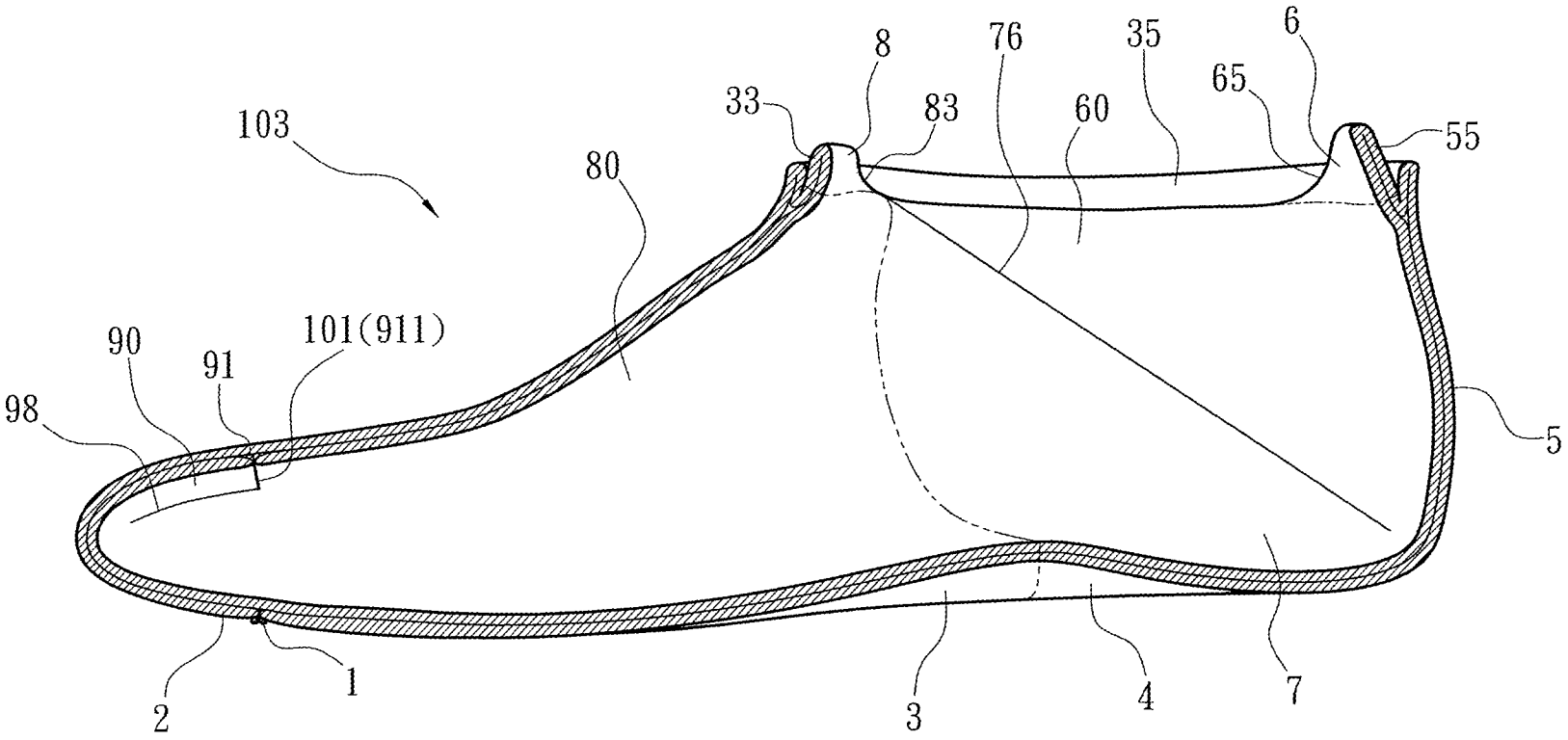
FIG. 24 is a section view of a the eighth preferred embodiment having been processed to a shaped shoe upper.

Refer to FIG. 23 and FIG. 24 showing a section view according to an eighth preferred embodiment of the present invention, and a section view of the eighth preferred embodiment having been processed to a shaped shoe upper. It is clearly seen from the diagrams that, a variation of the eighth preferred embodiment of the present invention compared to the fourth preferred embodiment of the present invention is that, the integral shoe upper fabric 100 further includes a reinforcing additional section 35, which is located between the first foot body knitted section 3 and the first instep extension section 33 and is knitted by the circular knitting machine. The circular knitting machine may additionally employ an elastic yarn to knit the reinforcing additional section 35. When the integral shoe upper fabric 100 is folded in reverse along the instep extension turning interknitting line 83 or the heel extension turning interknitting line 65 as a reference line, and the reinforcing additional section 35 between the centerline of the reinforcing additional section 35 and the first instep extension section 33 or the first heel extension section 55 is pressed to become recessed, the integral shoe upper fabric 100 becomes a form shown in FIG. 24. It should be noted that, the first opening 11 before having been sutured is as shown in FIG. 25, and may form a suture line 101 appearing as an inverted T, an inverted Y or a horizontal I after having been sutured, as shown in FIG. 23 and FIG. 24. Further, after the suture line 101 is formed, the first reserved suture section 1 may be appropriately trimmed as shown in FIG. 13 to FIG. 15. Further, the second opening 911 may form another suture line 101 appearing as an inverted T, an inverted Y or a horizontal I after having been sutured, and may be appropriately trimmed as shown in FIG. 23 and FIG. 24 after the suture line 101 is formed.

What is claimed is:

1. A method for knitting an integral shoe upper fabric by a circular knitting machine, comprising:

providing a circular knitting machine, and providing at least one non-elastic yarn for the circular knitting machine to perform knitting;

operating the circular knitting machine to knit a first reserved suture section including a first opening from the yarn;

operating the circular knitting machine to knit a first toe knitted section in continuation from an upper edge of the first reserved suture section;

operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section;

operating the circular knitting machine to knit a first sole extension section in continuation from a lower edge of the first foot body knitted section;

operating the circular knitting machine to turn the knitting direction from the first sole extension section, and sequentially knit a first heel knitted section and a second heel knitted section, with a first heel turning interknitting line interknitted between the first sole extension section and the first heel knitted section;

operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line;

operating the circular knitting machine to combine and knit in continuation from an edge of the second sole extension section and an upper edge of the first foot body knitted section to form a second foot body knitted section;

operating the circular knitting machine to knit in continuation from an upper edge of the second foot body knitted section, and turn the knitting direction to knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

2. A method for knitting an integral shoe upper fabric by a circular knitting machine, comprising:

providing a circular knitting machine, and providing at least one non-elastic yarn for the circular knitting machine to perform knitting;

operating the circular knitting machine to knit a first reserved suture section including a first opening from the yarn;

operating the circular knitting machine to knit a first toe knitted section in continuation from an upper edge of the first reserved suture section;

operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section;

operating the circular knitting machine to knit a first instep extension section in continuation from an upper edge of the first foot body knitted section;

causing operating the circular knitting machine to knit a first sole extension section in continuation from a lower edge of the first foot body knitted section;

operating the circular knitting machine to turn the knitting direction from the first sole extension section, and sequentially knit a first heel knitted section and a second heel knitted section, with a first heel turning interknitting line interknitted between the first sole extension section and the first heel knitted section;

operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line;

operating the circular knitting machine to turn the knitting direction, and knit a second instep extension section in continuation from the first instep extension section, with an instep extension turning interknitting line interknitted between the first instep extension section and the second instep extension section;

operating the circular knitting machine to combine and knit in continuation from an edge of the second sole extension section and an edge of the second instep extension section to form a second foot body knitted section;

operating the circular knitting machine to knit in continuation from an upper edge of the second foot body knitted section, turn the knitting direction, and knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

3. A method for knitting an integral shoe upper fabric by a circular knitting machine, comprising:

providing a circular knitting machine, and providing at least one non-elastic yarn for the circular knitting machine to perform knitting;

operating the circular knitting machine to knit a first reserved suture section including a first opening from the yarn;

operating the circular knitting machine to knit a first toe knitted section in continuation from an upper edge of the first reserved suture section;

operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section;

operating the circular knitting machine to knit a first sole extension section in continuation from a lower edge of the first foot body knitted section;

operating the circular knitting machine to turn the knitting direction, and knit a first heel knitted section in continuation from the first sole extension section, with a first heel turning interknitting line interknitted between the first sole extension section and the first heel knitted section;

operating the circular knitting machine to knit a first heel extension section in continuation from a lower edge of the first heel knitted section;

operating the circular knitting machine to turn the knitting, direction, and knit a second heel extension section in continuation from the first heel extension section, with a heel extension turning interknitting line interknitted between the first heel extension section and the second heel extension section;

operating the circular knitting machine to combine and knit in continuation from the second heel extension section and a side edge of the first heel knitted section to form a second heel knitted section;

operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line;

operating the circular knitting machine to combine and knit in continuation from an edge of the second sole extension section and an upper edge of the first foot body knitted section to form a second foot body knitted section;

operating the circular knitting machine to knit in continuation from an upper edge of the second foot body knitted section, turn the knitting direction, and knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

4. A method for knitting an integral shoe upper fabric by a circular knitting machine, comprising:

providing a circular knitting machine, and providing at least one non-elastic yarn for the circular knitting machine to perform knitting;

operating the circular knitting machine to knit a first reserved suture section including a first opening from the yarn;

operating the circular knitting machine to knit a first toe knitted section in continuation from an upper edge of the first reserved suture section;

operating the circular knitting machine to turn the knitting direction from the first toe knitted section, combine a lower edge of the first reserved suture section, and knit in continuation to form a first foot body knitted section, with a first toe turning interknitting line interknitted between the first toe knitted section and the first foot body knitted section;

operating the circular knitting machine to knit a first instep extension section in continuation from an upper edge of the first foot body knitted section;

operating the circular knitting machine to knit a first sole extension section in continuation from a lower edge of the first foot body knitted section;

operating the circular knitting machine to turn the knitting direction, and knit a first heel knitted section in continuation from the first sole extension section, with a first heel turning interknitting line interknitted between the first sole extension section and the first heel knitted section;

operating the circular knitting machine to knit a first heel extension section in continuation from a lower edge of the first heel knitted section;

operating the circular knitting machine to turn the knitting direction, and knit a second heel extension section in continuation from the first heel extension section, with a heel extension turning interknitting line interknitted between the first heel extension section and the second heel extension section;

operating the circular knitting machine to combine and knit in continuation from the second heel extension section and a side edge of the first heel knitted section to form a second heel knitted section;

operating the circular knitting machine to turn the knitting direction from the second heel knitted section, and knit a second sole extension section, with a second heel turning interknitting line interknitted between the second heel knitted section and the second sole extension section and symmetric to the first heel turning interknitting line;

operating the circular knitting machine to turn the knitting direction, and knit a second instep extension section in continuation from the first instep extension section, with an instep extension turning interknitting line interknitted between the first instep extension section and the second instep extension section;

operating the circular knitting machine to combine and knit in continuation from an edge of the second sole extension section and an edge of the second instep extension section to form a second foot body knitted section;

operating the circular knitting machine knit in continuation from an upper edge of the second foot body knitted section, and turn the knitting direction, knit a second toe knitted section, with a second toe turning interknitting line interknitted between the second foot body knitted section and the second toe knitted section; and operating the circular knitting machine to combine and knit in continuation from an edge of the second toe knitted section and a lower edge of the second foot body knitted section to form a second reserved suture section including a second opening that is asymmetric to the direction of the first opening of the first reserved suture section.

5. An integral shoe upper fabric, knitted by a circular knitting machine, the integral shoe upper fabric knitted from at least one non-elastic yarn provided to the round knitting machine; the integral shoe upper fabric comprising:

a first reserved suture section, knitted by the circular knitting machine and including a first opening;

a first toe knitted section, located at an upper edge side of the first reserved suture section and knitted by the circular knitting machine;

a first foot body knitted section, located at a turning side of the first toe knitted section and a lower edge side of the first reserved suture section, and knitted by the circular knitting machine, a first toe turning interknitting line being formed between the first toe knitted section and the first foot body knitted section;

a first sole extension section, located at a lower edge side of the first foot body knitted section and knitted by the circular knitting machine;

a first heel knitted section, located at a turning side of the first sole extension section and knitted by the circular knitting machine, a first heel turning interknitting line being formed between the first sole extension section and the first heel knitted section;

a second heel knitted section, located at an edge side of the first heel knitted section and knitted by the circular knitting machine;

a second sole extension section, located at a turning side of the second heel knitted section and knitted by the circular knitting machine, a second heel turning interknitting line being formed between the second heel knitted section and the second sole extension section and symmetric to the first heel turning knitting line;

a second foot body knitted section, located at an edge side of the second sole extension section and knitted by the circular knitting machine;

a second toe knitted section, located at an upper turning edge side of the second foot body knitted section and knitted by the circular knitting machine, a second toe turning interknitting line being formed between the second foot body knitted section and the second toe knitted section; and a second reserved suture section, located at an edge side of the second toe knitted section and a lower edge side of the second foot body knitted section, knitted by the circular knitting machine, and including a second opening that is asymmetric to the direction of the first opening of the first reserved suture section.

6. The integral shoe upper fabric knitted by a circular knitting machine of claim 5, further comprising a first instep extension section located at an upper edge side of the first foot body knitted section and knitted by the circular knitting machine, and a second instep extension section located at a turning side of the first instep extension section and knitted by the circular knitting machine, an instep extension turning interknitting line being formed between the first instep extension section and the second instep extension section.

7. The integral shoe upper fabric knitted by a circular knitting machine of claim 5, further comprising at least one first heel extension section located at a lower edge of the first heel knitted section and knitted by the circular knitting machine, and at least one second heel extension section located at a turning side of the first heel extension section and knitted by the circular knitting machine, at least one heel extension turning interknitting line being formed between the first heel extension section and the second heel extension section.

8. The integral shoe upper fabric knitted by a circular knitting machine of claim 6, further comprising at least one first heel extension section located at a lower edge of the first heel knitted section and knitted by the circular knitting machine, and at least one second heel extension section located at a turning side of the first heel extension section and knitted by the circular knitting machine, at least one heel extension turning interknitting line being formed between the first heel extension section and the second heel extension section.

9. The integral shoe upper fabric knitted by a circular knitting machine of claim 5, further comprising a reinforcing additional section, which is located between the first heel knitted section and the second heel knitted section and is knitted by the circular knitting machine.

10. The integral shoe upper fabric knitted by a circular knitting machine of claim 6, further comprising a reinforcing additional section, which is located between the first foot body knitted section and the first instep extension section and is knitted by the circular knitting machine.

11. The integral shoe upper fabric knitted by a circular knitting machine of claim 7, further comprising a reinforcing additional section, which is between the first heel knitted section and the first heel extension section and is knitted by the circular knitting machine.

12. The integral shoe upper fabric knitted by a circular knitting machine of claim 5, wherein the first opening forms a suture line appearing as an inverted T, an inverted Y or a horizontal I after having been sutured, and the first reserved suture section is appropriately trimmed after the suture line is formed.

13. The integral shoe upper fabric knitted by a circular knitting machine of claim 6, wherein the first opening forms a suture line appearing as an inverted T, an inverted Y or a horizontal I after having been sutured, and the first reserved suture section is appropriately trimmed after the suture line is formed.

14. The integral shoe upper fabric knitted by a circular knitting machine of claim 7, wherein the first opening forms a suture line appearing as an inverted T, an inverted Y or a horizontal I after having been sutured, and the first reserved suture section is appropriately trimmed after the suture line is formed.

15. The integral shoe upper fabric knitted by a circular knitting machine of claim 8, wherein the first opening forms a suture line appearing as an inverted T, an inverted Y or a horizontal I after having been sutured, and the first reserved suture section is appropriately trimmed after the suture line is forming.

16. The integral shoe upper fabric knitted by a circular knitting machine of claim 9, wherein the first opening forms a suture line appearing as an inverted T, an inverted Y or a horizontal I after having been sutured, and the first reserved suture section is appropriately trimmed after the suture line is formed.

17. The integral shoe upper fabric knitted by a circular knitting machine of claim 10, wherein the first opening forms a suture line appearing as an inverted T, an inverted Y or a horizontal I after having been sutured, and the first reserved suture section is appropriately trimmed after the suture line is formed.

18. The integral shoe upper fabric knitted by a circular knitting machine of claim 11, wherein the first opening forms a suture line appearing as an inverted T, an inverted Y or a horizontal I after having been sutured, and the first reserved suture section is appropriately trimmed after the suture line is formed.

* * * * *